US007345662B2

(12) United States Patent
Iwami

(10) Patent No.: US 7,345,662 B2
(45) Date of Patent: Mar. 18, 2008

(54) APPARATUS FOR DRIVING CAPACITIVE LIGHT EMITTING ELEMENTS

(75) Inventor: Takashi Iwami, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 701 days.

(21) Appl. No.: 10/862,882

(22) Filed: Jun. 8, 2004

(65) Prior Publication Data

US 2005/0012725 A1 Jan. 20, 2005

(30) Foreign Application Priority Data

Jun. 12, 2003 (JP) ..... 2003-167627
Oct. 22, 2003 (JP) ..... 2003-362229

(51) Int. Cl.
*G09G 3/32* (2006.01)

(52) U.S. Cl. ..... 345/82; 345/76; 315/169.1

(58) Field of Classification Search ..... 345/60, 345/76–83; 315/169.1–169.4
See application file for complete search history.

(56) References Cited

U.S. PATENT DOCUMENTS 5,081,400 A * 1/1992 Weber et al. ..... 315/169.4
5,642,018 A * 6/1997 Marcotte ..... 315/169.4
6,011,355 A * 1/2000 Nagai ..... 315/169.3
6,150,999 A * 11/2000 Chen et al. ..... 345/60
6,304,038 B1 10/2001 Ide et al.
6,333,738 B1 * 12/2001 Ide ..... 345/211
6,963,174 B2 * 11/2005 Lee et al. ..... 315/169.3
2001/0054994 A1 * 12/2001 Hsu et al. ..... 345/60
2002/0063304 A1 5/2002 Toeda et al.

FOREIGN PATENT DOCUMENTS

EP 0 895 217 A1 2/1999
JP 2002-156941 A 5/2002

* cited by examiner

*Primary Examiner*—Richard Hjerpe
*Assistant Examiner*—Kimnhung Nguyen
(74) *Attorney, Agent, or Firm*—Sughrue Mion, PLLC

(57) ABSTRACT

An apparatus for driving capacitive light emitting diodes which can be reduced in size. For supplying a capacitive light emitting diode with a driving pulse which varies the voltage with a predetermined amplitude through a driving line, the driving apparatus comprises a resonance current path including a capacitor, a first switching element for supplying the driving line with a current in accordance with charges accumulated on the capacitor when it is on, and a second switching element for grounding one electrode of the capacitor when it is on, thereby supplying the other electrode of the capacitor with a current in accordance with charges accumulated in the capacitive light emitting element through the driving line.

7 Claims, 20 Drawing Sheets

APPARATUS FOR DRIVING CAPACITIVE LIGHT EMITTING ELEMENTS

BACKGROUND OF THE INVENTION

1. Field of the Invention

The present invention relates to an apparatus for driving capacitive light emitting elements.

2. Description of the Related Art

Nowadays, display panels comprising capacitive light emitting elements such as a plasma display panel (hereinafter referred to as the "PDP"), an electroluminescence display panel (hereinafter referred to as the "ELP") and the like have been brought into practical use to provide wall-mounted television sets.

FIG. 1 generally shows such a plasma display panel which has a PDP as a display panel (see, for example, FIG. 3 of Japanese Patent Kokai No. 2002-156941).

In FIG. 1, a PDP 10 as a plasma display panel comprises row electrodes $Y_1$-$Y_n$ and $X_1$-$X_n$ which form pairs of row electrodes X, Y, each of which corresponds to each of a first to an n-th row of one screen. The PDP 10 is further formed with column electrodes $Z_1$-$Z_m$ corresponding to respective columns (first to m-th columns) of one screen, which are orthogonal to the row electrode pairs and across a dielectric layer and a discharge space, not shown. A discharge cell serving as a pixel is formed at the intersection of a pair of row electrodes (X, Y) with a column electrode Z.

A row electrode driving circuit 30 generates a sustain pulse for repeatedly discharging a discharge cell which has a wall charge remaining therein, and applies the sustain pulse to the row electrodes $X_1$-$X_n$ of the PDP 10. A row electrode driving circuit 40 generates a reset pulse for initializing the states of all the discharge cells, a scanning pulse for sequentially selecting a display line into which pixel data is written, and a sustain pulse for repeatedly discharging a discharge cell which has a wall charge remaining therein, and applies these pulses to the row electrodes $Y_1$-$Y_n$.

A driving control circuit 50 converts an input video signal, for example, to 8-bit pixel data for each pixel which is divided for each bit digit to generate pixel data bits. Then, the driving control circuit 50 supplies a column electrode driving circuit 20 with pixel data bits $DB_1$-$DB_m$ corresponding to the first to m-th columns belonging to each display line. Further, in this period, the driving control circuit 50 generates switching signals SW1-SW3, as shown in FIG. 2, which are supplied to the column electrode driving circuit 20.

FIG. 3 is a diagram showing the internal configuration of the column electrode driving circuit 20.

As shown in FIG. 3, the column electrode driving circuit 20 comprises a power supply circuit 21 for generating a resonance pulse power supply voltage having a predetermined amplitude and applying a power supply line 2 with the resonance pulse power supply voltage; and a pixel data pulse generating circuit 22 for generating a pixel data pulse based on the resonance pulse power supply voltage.

A capacitor C1 in the power supply circuit 21 has one electrode connected to a ground potential Vs as a ground potential for the PDP 10. A switching element S1 is controlled to turn on/off in response to the switching signal SW1. In this event, as the switching element S1 turns on, a voltage generated on the other electrode of the capacitor C1 is applied to the power supply line 2 through a coil L1 and a diode D1. A switching element S2 is controlled to turn on/off in response to the switching signal SW2. In this event, as the switching element S2 turns on, a voltage on the power supply line 2 is applied to the other electrode of the capacitor C1 through a coil L2 and a diode D2 to charge the capacitor C1. A switching element S3 is controlled to turn on/off in response to the switching signal SW3. In this event, as the switching element S3 turns on, a power supply voltage Va generated by a DC power supply B1 is applied to the power supply line 2. The DC power supply B1 has a negative electrode terminal grounded at the ground potential Vs.

The power supply circuit 21, which operates as described above, results in the generation of the resonance pulse power supply voltage, on the power supply line 2, having a maximum voltage equal to the power supply voltage Va, and a resonance amplitude $V_1$, as shown in FIG. 2.

A pixel data pulse generator circuit 22 has switching elements $SWZ_1$-$SWZ_m$ and $SWZ_{10}$-$SWZ_{m0}$ which are controlled independently of one another to turn on/off in response to associated pixel data bits $DB_1$-$DB_m$ of one display line (m bits) supplied from the driving control circuit 50. Each of the switching elements $SWZ_1$-$SWZ_m$ turns on when the pixel data bit DB supplied thereto is at logical level "1" to supply the resonance pulse power supply voltage on the power supply line 2 to the column electrodes $Z_1$-$Z_m$.

Here, the switching elements S1-S3, which are switched to generate the resonance pulse power supply voltage, are each actually comprised of FET (Field Effect Transistor). In this event, the switching element S2 performs a switching operation with a reference potential which is the potential on the one electrode of the capacitor C1. For this reason, a capacitor having a large capacitance has been employed for the capacitor C1 in order to reduce fluctuations in the reference potential to stabilize the switching operation of the switching element S2.

However, a capacitor having a large capacitance is large in shape, implying a problem that a resulting driving apparatus is increased in size.

SUMMARY OF THE INVENTION

It is an object of the present invention to provide an apparatus for driving capacitive light emitting diodes, which can be reduced in size.

The present invention provides an apparatus for driving capacitive light emitting elements by supplying the capacitive light emitting elements with a driving pulse having a varying voltage with a predetermined amplitude through a driving line. The apparatus comprises a resonance current path which includes a capacitor, a first switching element for supplying the driving line with a current in accordance with charges accumulated on the capacitor when the first switching element is on, and a second switching element for grounding one electrode of the capacitor when the second switching element is on to supply the other electrode of the capacitor with a current in accordance with the charges accumulated on the capacitive light emitting element through the driving line.

DETAILED DESCRIPTION OF THE INVENTION

One electrode of a charge recovery capacitor is grounded to supply the other electrode of the capacitor with a current in accordance with a charge accumulated in a capacitive light emitting diode to recover the charge.

Figure 1:
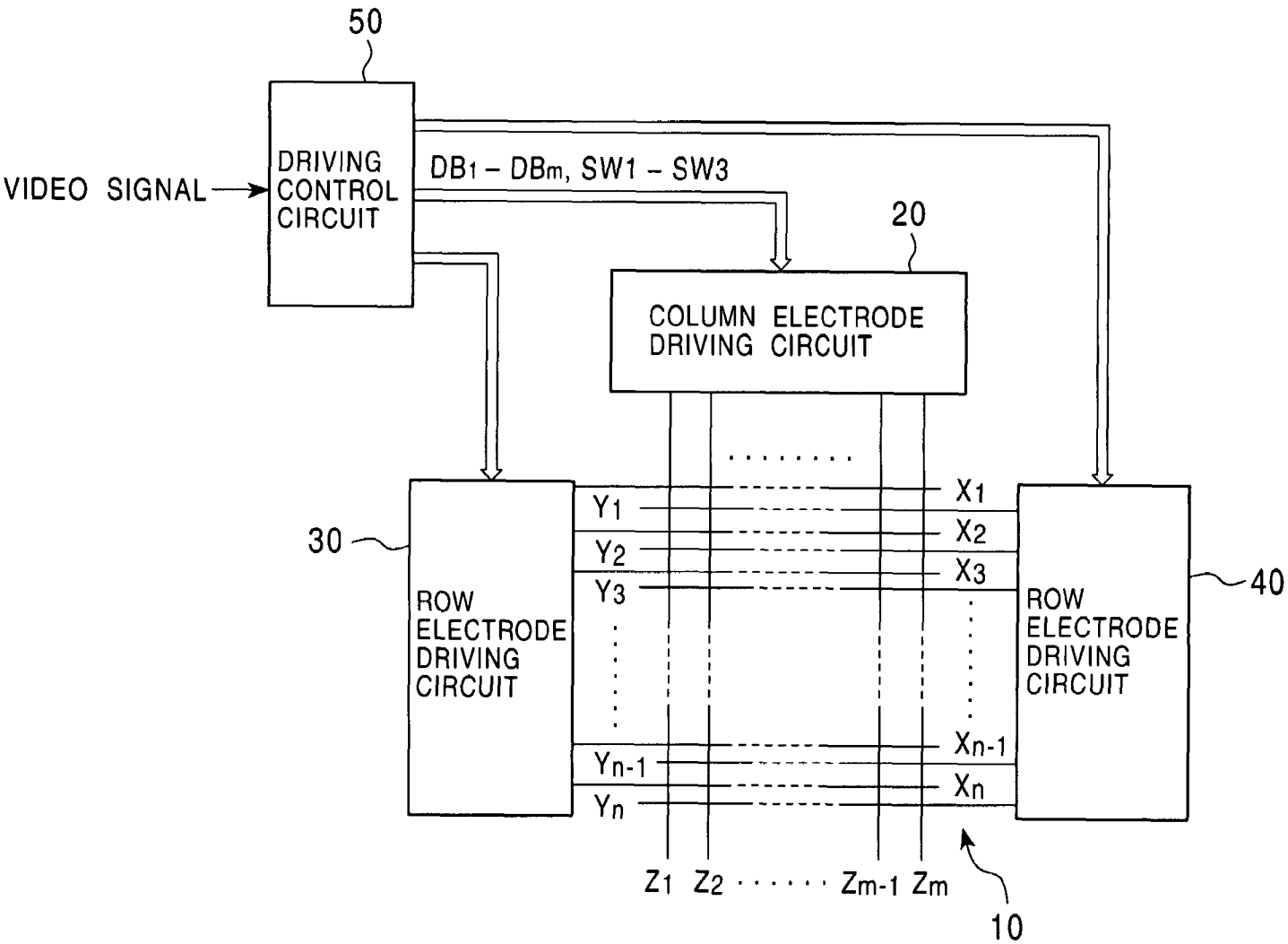
FIG. 1 is a diagram generally showing the configuration of a plasma display device which is equipped with a plasma display panel for a display panel.
Figure 2:
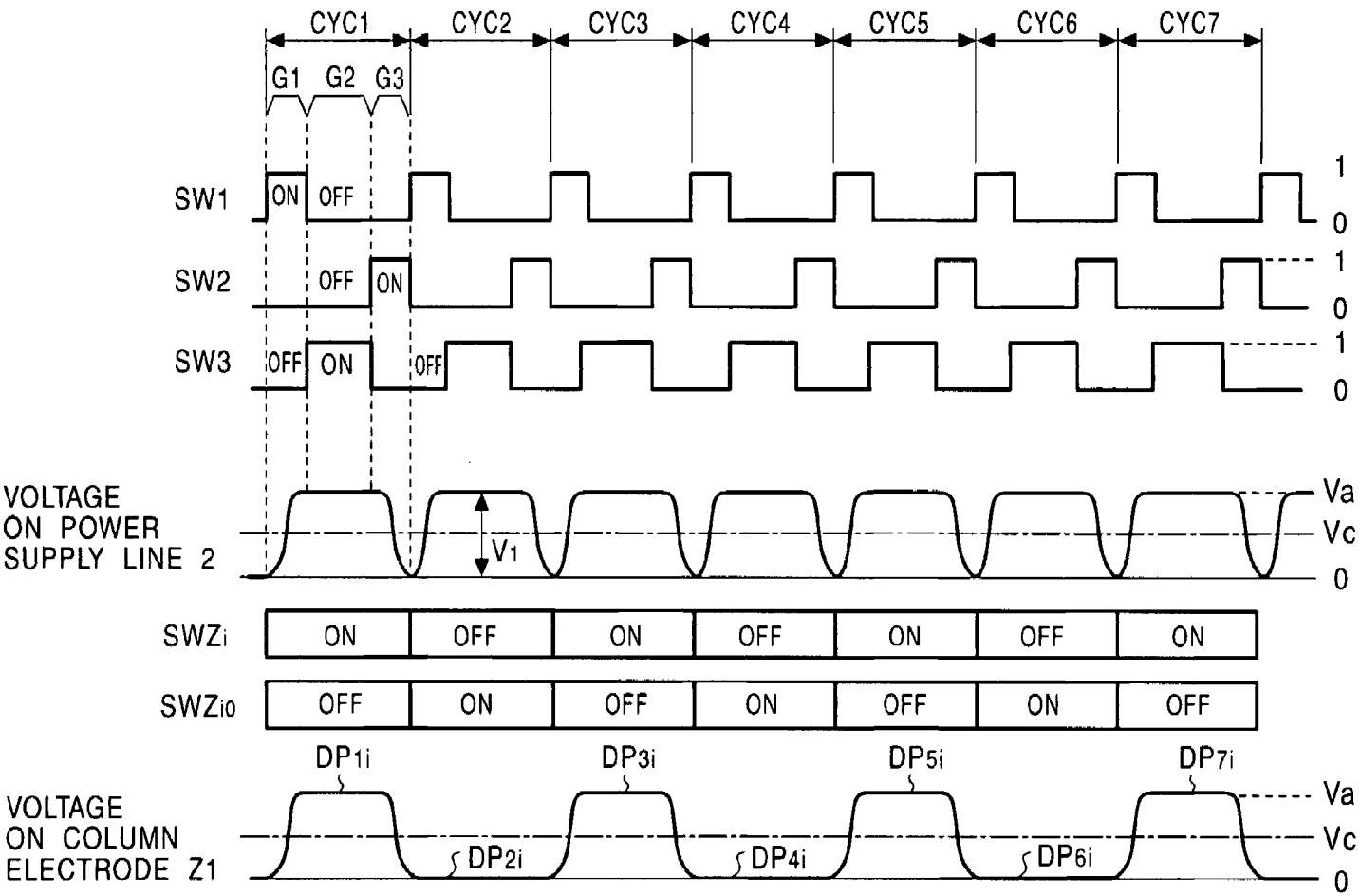
FIG. 2 is a diagram showing switching signals SW1-SW3 supplied by a driving control circuit 50 shown in FIG. 1 to a column electrode driving circuit 20, and the internal operation of a column electrode driving circuit 20.
Figure 3:
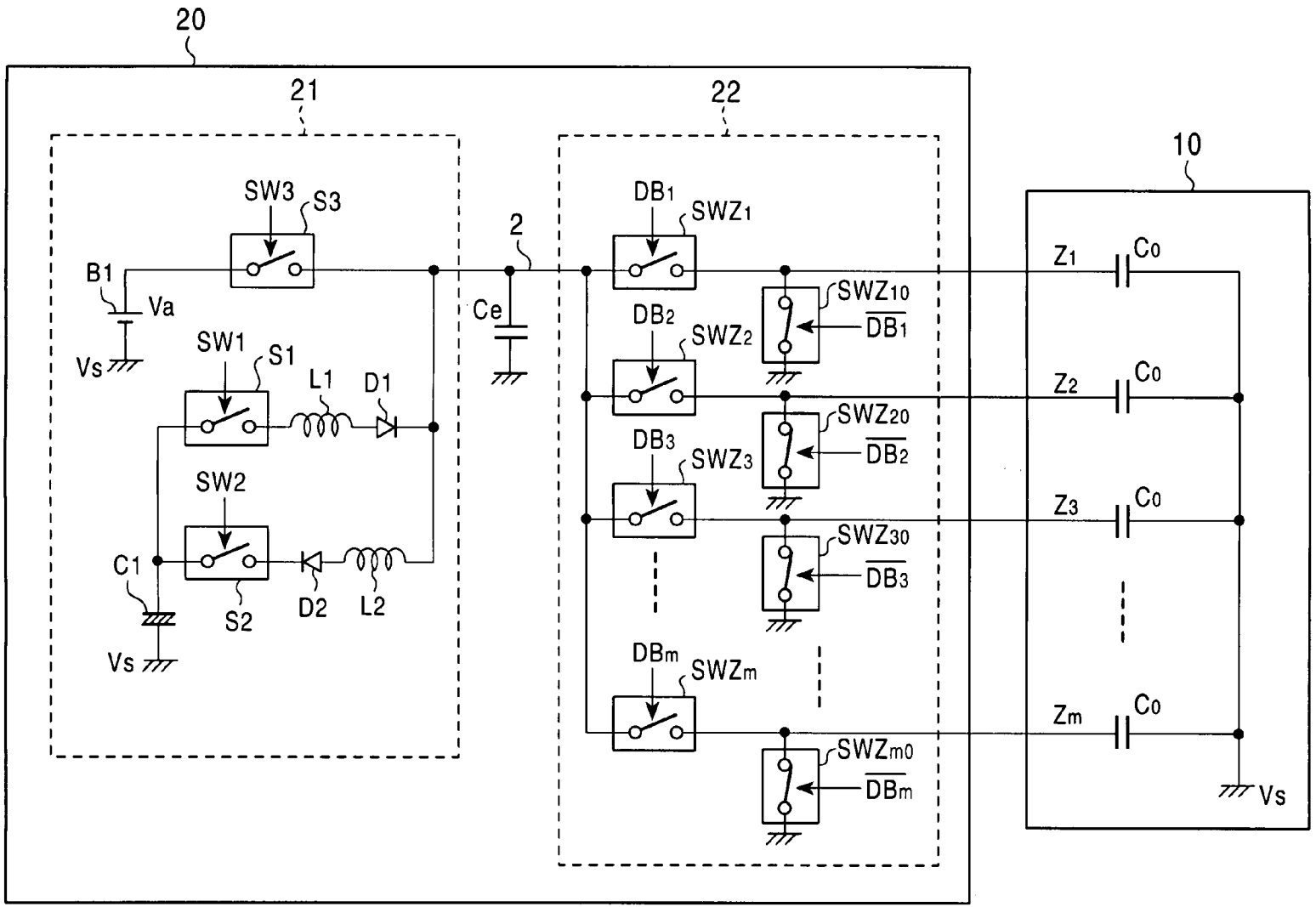
FIG. 3 is a diagram showing the internal configuration of the column electrode driving circuit 20.
Figure 4:
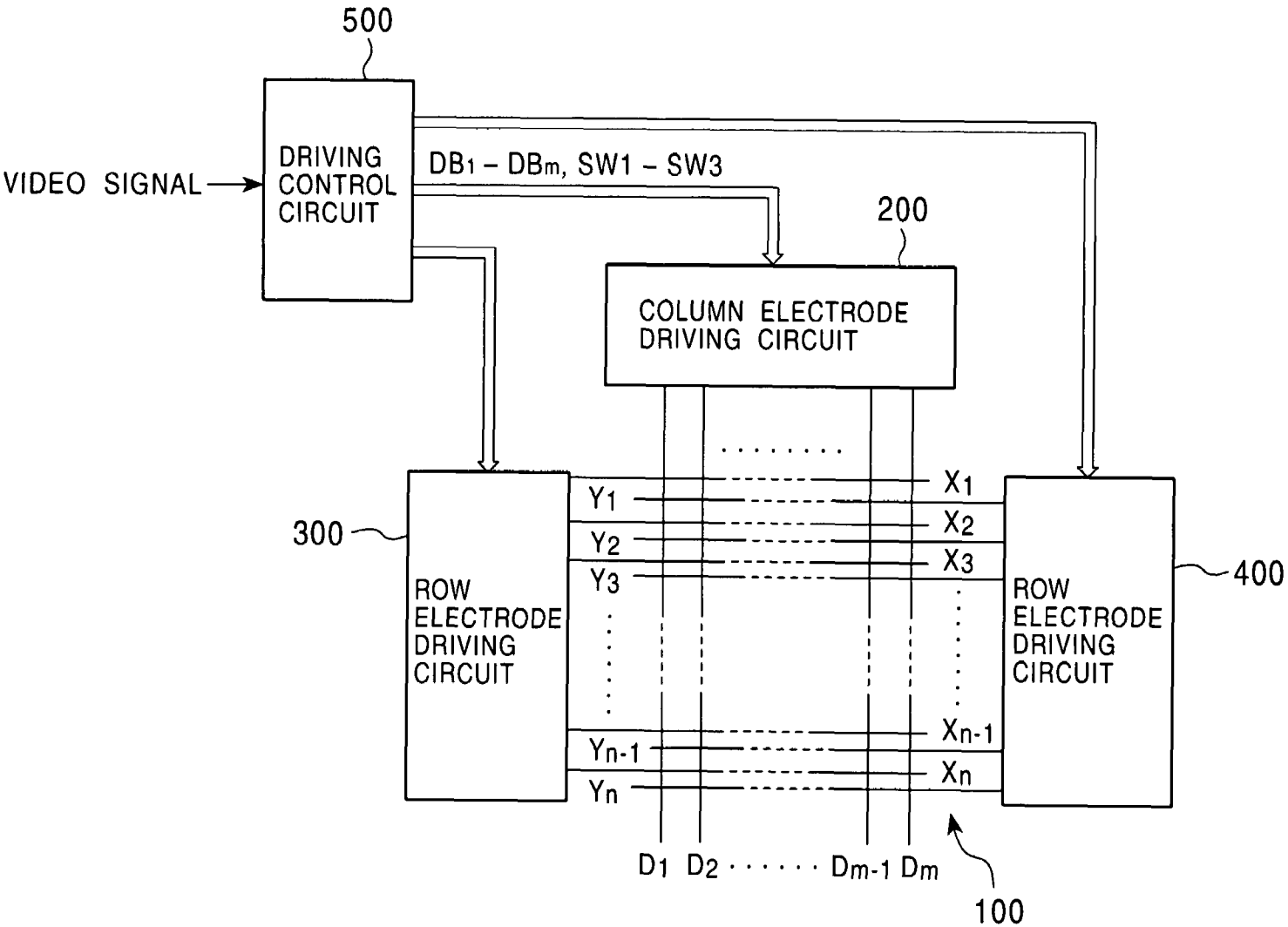
FIG. 4 is a diagram showing the configuration of a plasma display device which is equipped with a driving apparatus according to the present invention.

FIG. 4 is a diagram showing the configuration of a plasma display device which is equipped with a driving apparatus according to the present invention.

In FIG. 4, a PDP 100 as a plasma display panel comprises row electrodes $Y_1$-$Y_n$ and $X_1$-$X_n$ which form pairs of row electrodes X, Y, that make up a first to an n-th row of one screen, respectively. The PDP 100 is further formed with column electrodes $D_1$-$D_m$ corresponding to a first to a m-th column of one screen, respectively, which are orthogonal to the row electrode pairs and across a dielectric layer and a discharge space, not shown. A discharge cell serving as a pixel is formed at the intersection of a pair of row electrodes (X, Y) with a column electrode D.

A driving control circuit 500 generates a variety of timing signals for driving the PDP 100 to implement a gradational display based on a sub-field method, and supplies the generated timing signals to row electrode driving circuits 300, 400. The driving control circuit 500 also divides pixel data for each pixel based on an input video signal for each bit digit to generate data bits DB. Then, the driving control circuit 500 supplies a column electrode driving circuit 200 with one display line of the pixel data bits ($DB_1$-$DB_m$) together with switching signals SW1-SW3.

The column electrode driving circuit 200 generates pixel data pulses (later described) in accordance with the switching signals SW1-SW3 and pixel data bits $DB_1$-$DB_m$. The row electrode driving circuits 300, 400 generate a variety of driving pulses (described later) in response to a variety of timing signals supplied thereto from the driving control circuit 500, and apply the driving pulses to the row electrodes X and Y of the PDP 100. A gradation driving procedure based on the sub-field method divides one field period in an input video signal into a plurality of sub-fields, and drives each of discharge cells to emit light in each sub-field.

Figure 5:
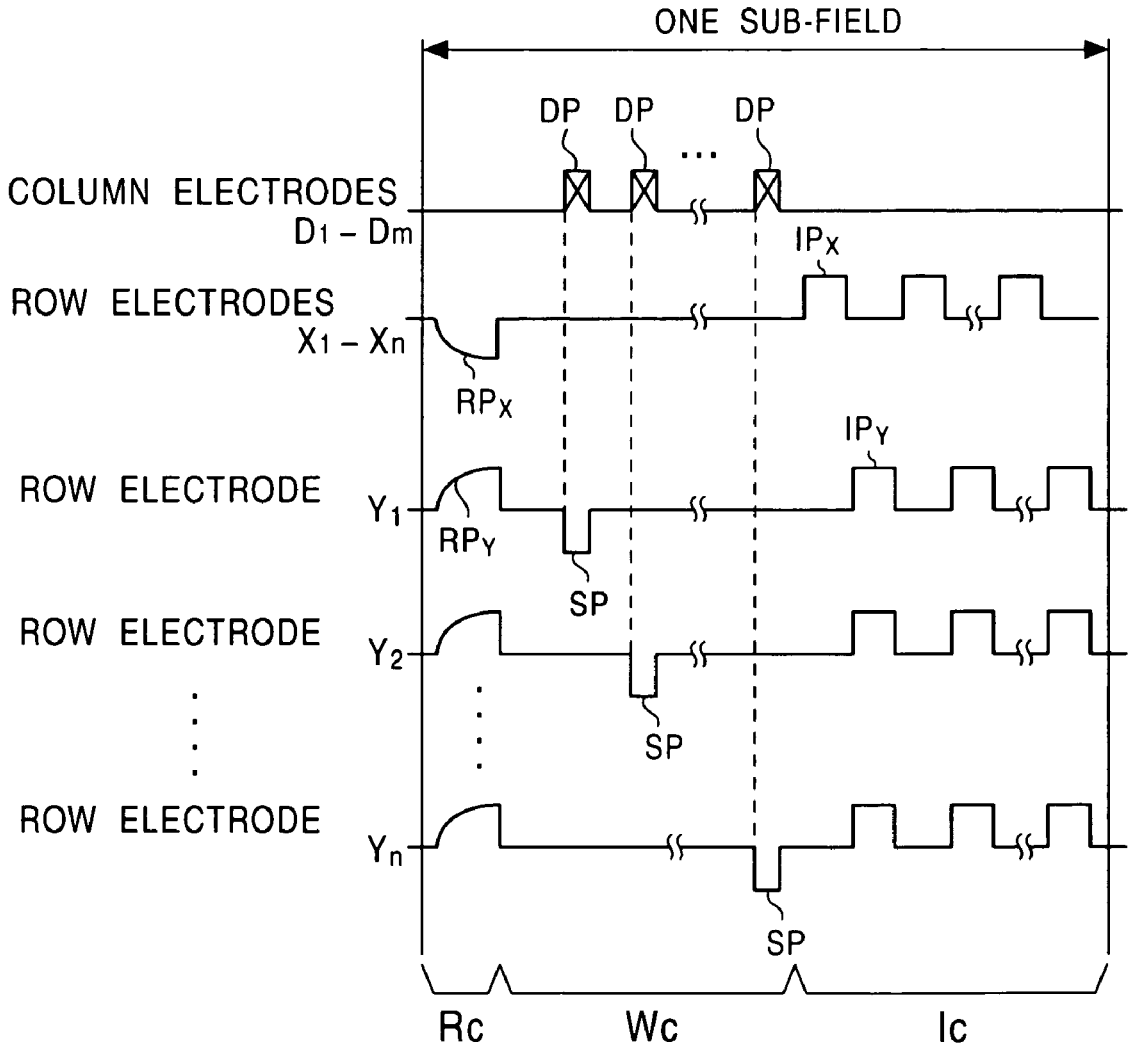
FIG. 5 is a diagram showing a variety of driving pulses applied to a PDP 100 in one sub-field.

FIG. 5 is a diagram showing exemplary driving pulses applied by the column electrode driving circuit 200 and row electrode driving circuits 300, 400 in one sub-field.

As shown in FIG. 5, the sub-field consists of a simultaneous reset stage Rc, an addressing stage Wc, and a sustain stage Ic.

In the simultaneous reset stage Rc, the row electrode driving circuit 300 generates a reset pulse $RP_X$ as shown in FIG. 5, which is applied to each of the row electrodes $X_1$-$X_n$ of the PDP 100. Further, in the simultaneous reset stage Rc, the row electrode driving circuit 400 generates a reset pulse $RP_Y$ as shown in FIG. 5 at the same timing as the reset pulse $RP_X$, and applies the reset pulse $RP_Y$ to each of the row electrodes $Y_1$-$Y_n$ of the PDP 100. In response to the application of these reset pulses $RP_X$, $PR_Y$, a reset discharge occurs in all the discharge cells to uniformly form wall charges in the respective discharge cells.

In the addressing stage Wc, the row electrode driving circuit 400 generates a scanning pulse SP as shown in FIG. 5 which is sequentially applied to each of the row electrodes $Y_1$-$Y_n$ of the PDP 100 as shown in FIG. 5. Further, in the addressing stage Wc, the column electrode driving circuit 200 generates m pixel data pulses DP having pulse voltages corresponding to the logical levels of the respective data bits $DB_1$-$DB_m$ in synchronism with the timing at which the column electrode driving circuit 200 applies each scanning pulse SP, and applies the generated pixel data pulses DP to the column electrodes $D_1$-$D_m$, respectively. For example, the column electrode driving circuit 200 first applies the respective column electrodes $D_1$-$D_m$ with m pixel data pulses DP corresponding to the first display line, respectively, in synchronism with the timing of the scanning pulse SP applied to the row electrode $Y_1$, as shown in FIG. 5. Next, the column electrode driving circuit 200 applies the column electrodes $D_1$-$D_m$ with m pixel data pulses DP corresponding to the second display line, respectively, in synchronism with the timing of the scanning pulse SP applied to the row electrode $Y_2$, as shown in FIG. 5. In the addressing stage Wc, an erasure discharge selectively occurs in a discharge cell which is applied with a high-voltage pixel data pulse simultaneously with the scanning pulse SP to extinguish the wall charge previously formed within the discharge cell. On the other hand, the erasure discharge does not occur in a discharge cell which is applied with the scanning pulse SP but is also applied with a low-voltage pixel data pulse, so that the wall discharge remains therein.

In the sustain stage Ic, the respective row electrode driving circuits 300, 400 alternately generate sustain pulses $IP_X$, $IP_Y$ which are applied to the row electrodes $X_1$-$X_n$ and $Y_1$-$Y_n$. Each time these sustain pulses $IP_X$, $IP_Y$ are applied, a sustain discharge occurs in a discharge cell in which the wall charge remains, thereby sustaining a light emission state associated with the discharge.

Figure 6:
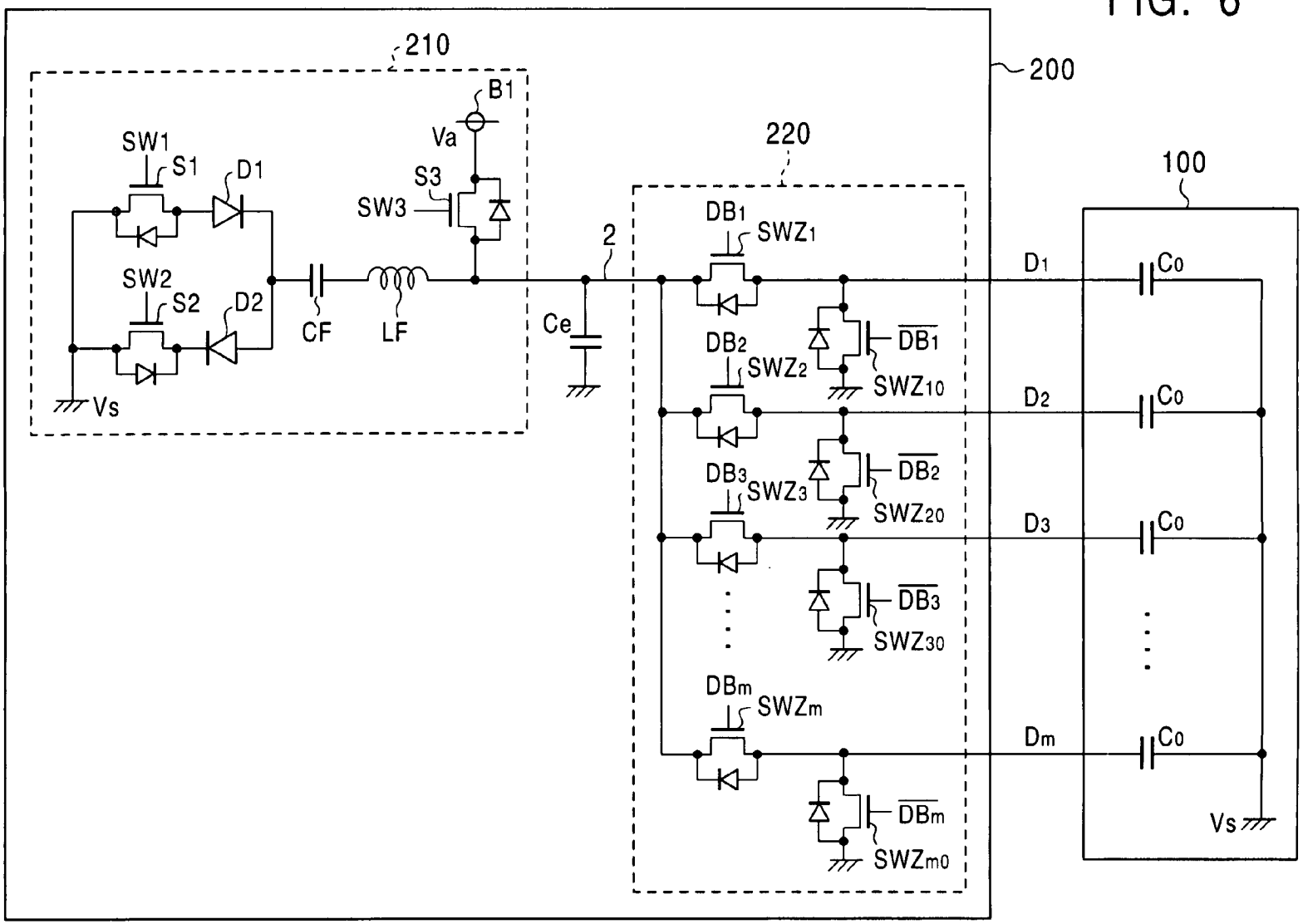
FIG. 6 is a diagram showing the internal configuration of a column electrode driving circuit 200 shown in FIG. 4.

FIG. 6 is a diagram showing the internal configuration of the column electrode driving circuit 200 for generating the pixel data pulses as mentioned above.

As shown in FIG. 6, the column electrode driving circuit 200 comprises a power supply circuit 210 for generating a resonance pulse power supply voltage having a predetermined amplitude; and a pixel data pulse generator circuit 220 for generating a pixel data pulse based on the resonance pulse power supply voltage.

Switching elements S1-S3 in the power supply circuit 210 are FETs (Field Effect Transistor). The switching element S3 has a source electrode connected to a positive electrode terminal of a DC power supply B1, and a drain electrode connected to a driving line 2. Also, the switching element S3 is supplied with the switching signal SW3 at a gate electrode thereof. The switching element S3 turns off when the switching signal SW3 is at logical level "0," and turns on when the switching signal SW3 is at logical level "1," to apply a power supply voltage Va generated in the DC power supply B1 to the driving line 2.

The switching element S1 has a source electrode set at a ground potential Vs, and a drain electrode connected to an anode electrode of a diode D1. Also, the switching element S2 is supplied with the switching signal SW1 at a gate electrode thereof. The switching element S2 has a source electrode set at the ground potential Vs, and a drain electrode connected to a cathode electrode of a diode D2. Also, the switching element S1 is supplied with the switching signal SW2 at a gate electrode thereof. The cathode electrode of the diode D1 and the anode electrode of the diode D2 are commonly connected to one electrode of a capacitor CF. The capacitor CF has the other electrode connected to one electrode of a coil LF. The coil LF has the other electrode connected to the driving line 2.

A current path including the switching element S1 and diode D1 serves as a discharging current path, while a current path including the switching element S2 and diode D2 serves as a charging current path.

Figure 7:
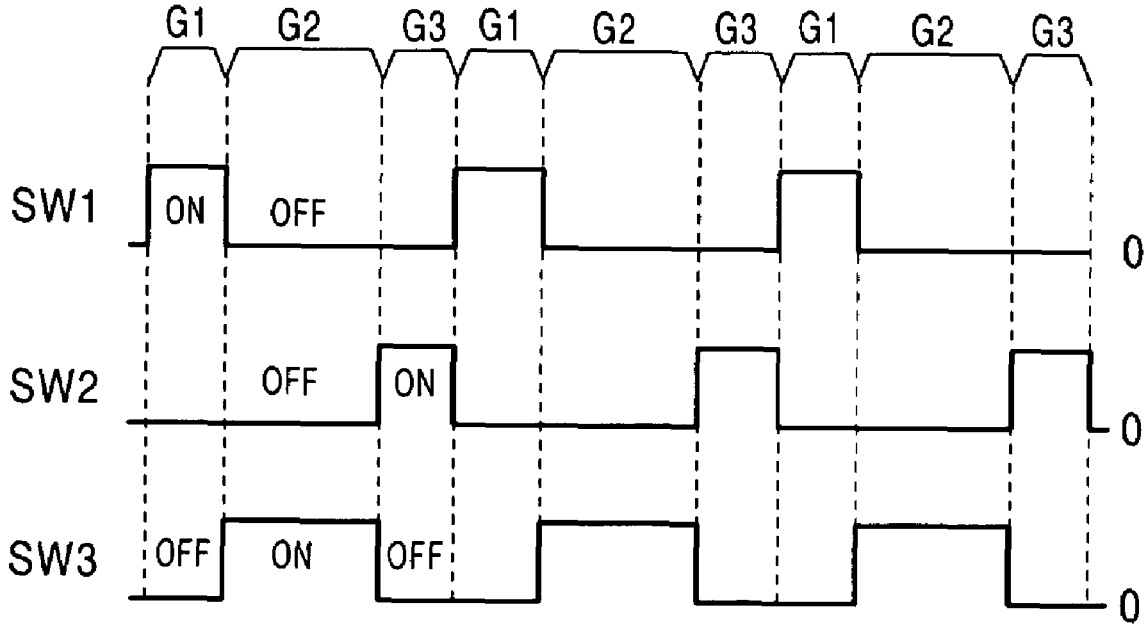
FIG. 7 is a diagram showing switching signals SW1-SW3 supplied by a driving control circuit 500 shown in FIG. 4 to switching elements S1-S3, respectively, of a power supply circuit 210.

FIG. 7 is a diagram showing the switching signals SW1-SW3 which are supplied to the switching elements S1-S3, respectively, of the power supply circuit 210 by the driving control circuit 500.

In FIG. 7, the driving control circuit 500 first supplies the switching signal SW1 at logical level "1" to the switching element S1, and supplies the switching signals SW2, SW3 both at logical level "0" to the switching elements S2, S3, respectively (driving stage G1). In response to the execution of the driving stage G1, the switching element S1 turns on to discharge a charge charged on the capacitor CF, causing a current associated with the discharge to flow into the driving line 2 through the coil LF.

Next, the driving control circuit 500 switches the switching signal SW1 to logical level "0," and the switching signal SW3 to logical level "1" (driving stage G2). In response to the execution of the driving stage G2, only the switching element S3 of S1-S3 turns on to apply the power supply voltage Va generated by the DC power supply B1 to the driving line 2. In other words, the voltage on the driving line 2 is fixed at the power supply voltage Va in this period.

Next, the driving control circuit 500 switches the switching signal SW2 to logical level "1," and the switching signal SW3 to logical level "0" (driving stage G3). In response to the execution of the driving stage G3, only the switching element S2 of S1-S3 turns on to set one electrode of the capacitor CF to the ground potential Vs. Consequently, a current flows into the capacitor CF from the driving line 2 through the coil LF to charge the capacitor CF.

The driving control circuit 500 repeatedly executes a driving sequence shown in the foregoing driving stages G1-G3. In the driving stage G2, the switching element S1 may be on.

The pixel data pulse generator circuit 220 comprises switching elements $SWZ_1$-$SWZ_m$ and $SWZ_{10}$-$SWZ_{m0}$ which are independently controlled to turn on/off in response to the pixel data bits $DB_1$-$DB_m$ supplied from the driving control circuit 500. Each of the switching elements $SWZ_1$-$SWZ_m$ turns on only when the pixel data bit DB respectively supplied thereto is at logical level "1" to apply the resonance pulse power supply voltage on the driving line 2 to the column electrodes $D_1$-$D_m$ of the PDP 100. On the other hand, each of the switching elements $SWZ_{10}$-$SWZ_{m0}$ turns on only when the pixel data bit DB is at logical level "0" to set the column electrode D to the ground potential Vs.

Next, the operation of the column electrode driving circuit 200 shown in FIG. 6 will be described with reference to FIG. 8.

Figure 8:
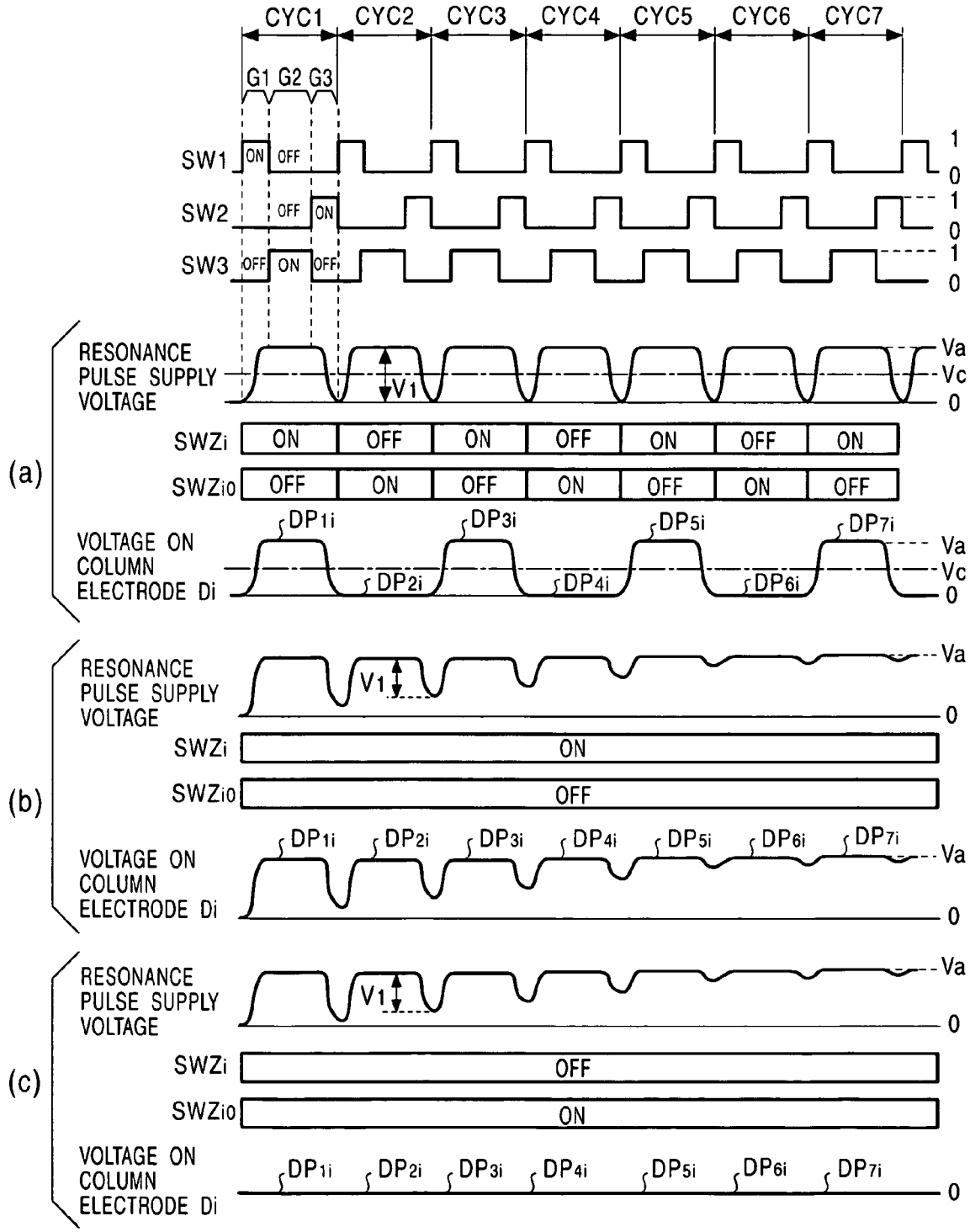
FIG. 8 is a diagram representing the internal operation of the column electrode driving circuit 200.

Portions (a)-(c) of FIG. 8 partially show the operation involved in generating the pixel data pulses DP for the first to seventh display lines in an i-th column (i is in a range of 1-m) of the PDP 100.

In this event, the portion (a) of FIG. 8 shows a change in the resonance pulse power supply voltage on the driving line 2 when a bit sequence of the pixel data bits DB corresponding to an i-th column of the respective first to seventh lines shows:

[1, 0, 1, 0, 1, 0, 1]

The portion (b) of FIG. 8 shows a change in the resonance pulse power supply voltage on the driving line 2 when a bit sequence of the pixel data bits DB corresponding to an i-th column of the respective first to seventh lines shows:

[1, 1, 1, 1, 1, 1, 1]

The portion (c) of FIG. 8 shows a change in the resonance pulse power supply voltage on the driving line 2 when a bit sequence of the pixel data bits DB corresponding to an i-th column of the respective first to seventh lines shows:

[0, 0, 0, 0, 0, 0, 0]

First, when a bit sequence of the pixel data bits DB corresponding to an i-th column of the respective first to seventh lines is [1, 0, 1, 0, 1, 0, 1] as shown in the portion (a) of FIG. 8, the switching elements $SWZ_i$, $SWZ_{i0}$ repeatedly turn on and off. In this event, in the driving stage G1, only the switching element S1 of the switching elements S1-S3 turns on to discharge a charge accumulated on the capacitor CF as shown in FIG. 6. Here, when the switching element $SWZ_i$ is on, a discharge current associated with the discharge of the capacitor CF flows into a column electrode Di of the PDP 100 through the discharging current path including the switching element S1 and diode D1, capacitor CF, coil LF, driving line 2, and switching element $SWZ_i$. Consequently, a load capacitance Co, which is parasitic on the column electrode $D_i$, is charged to accumulate charges within the load capacitance Co. In this event, a resonance action of the coil LF and load capacitance Co causes a gradual increase in the voltage on the driving line 2, where this voltage rising portion defines a front edge of the resonance pulse power supply voltage. Next, as the driving stage G2 is executed, only the switching element S3 of the switching elements S1-S3 turns on to apply the power supply voltage Va generated by the DC power supply B1 to the driving line 2 through the switching element S3. With this applied voltage, the load capacitance Co parasitic on the column electrode $D_i$ is charged to accumulate charges thereon. Next, as the driving stage G3 is executed, only the switching element S2 of the switching elements S1-S3 turns on to set one electrode of the capacitor CF to the ground potential Vs. This causes the load capacitance Co of the PDP 100 to start discharging, so that the resulting discharge current flows through the column electrode $D_i$, switching element $SWZ_i$, driving line 2, coil LF, capacitor CF, and a current path including the diode D2 and switching element S2, causing the capacitor CF to start charging. In other words, the charges accumulated in the load capacitance Co of the PDP 100 is recovered to the capacitor CF. In this event, the voltage on the driving line 2 gradually decreases in accordance with the time constant determined by the coil LF and load capacitance Co. In this event, a slowly falling portion of the voltage on the driving line 2 as mentioned above defines a rear edge of the resonance pulse power supply voltage.

Then, after the completion of the driving stage G3, the operations of the driving stages G1-G3 are repeatedly performed.

Here, in the portion (a) of FIG. 8, the switching element $SWZ_i$ is off in each of a second cycle CYC2, a fourth cycle CYC4, and a sixth cycle CYC6. Thus, the column electrode $D_i$ is applied with pixel data pulses $DP_{2i}$, $DP_{4i}$, $DP_{6i}$ at low voltage (zero volt) corresponding to the second, fourth, and sixth display lines, respectively. Also, in these even-numbered cycles CYC, since the switching element $SWZ_{i0}$ is on, charges remaining on the load capacitance Co of the PDP 100 are recovered through a current path including the column electrode $D_i$ and switching element $SWZ_{i0}$. Therefore, for example, when the switching element $SWZ_i$ switches from the off-state to the on-state immediately after the third cycle CYC3 has started after the end of the second cycle CYC2, the voltage on the driving line 2 is approximately zero volt, as shown in the portion (a) of FIG. 8.

In summary, when a bit sequence has alternately inverting pixel data bits DB on one line, such as [1, 0, 1, 0, 1, 0, 1], for each display line, the driving line 2 is applied with the resonance pulse power supply voltage having a maximum voltage equal to the power supply voltage Va and a resonance amplitude $V_1$, as shown in the portion (a) of FIG. 8.

On the other hand, when a bit sequence has pixel data bits DB at logical "1" in succession on one line, such as [1, 1, 1, 1, 1, 1, 1], for each line, the switching element $SWZ_i$ remains on, while $SWZ_{i0}$ remains off, as shown in the portion (b) of FIG. 8. Specifically, in this period, no charges are recovered by the current path including the column electrode $D_i$ and switching element $SWZ_{i0}$, unlike the situation shown in the portion (a) of FIG. 8. Consequently, charges which were not fully recovered in the driving stage G3 gradually accumulate in the load capacitance Co of the PDP 100. As a result, the resonance pulse power supply voltage applied to the driving line 2 maintains the maximum voltage equal to the power supply voltage Va with the gradually falling resonance amplitude $V_1$, as shown in the portion (b) of FIG. 8. This is applied as it is to the column electrodes $D_i$ as high-voltage pixel data pulses $DP_{1i}$-$DP_{7i}$.

Stated another way, when a bit sequence has pixel data bits DB at logical "1" in succession on one line, a voltage applied to the column electrode D need not be reshaped into a pulse, so that the resonance power supply voltage is reduced with the resonance amplitude $V_1$ maintained at its maximum voltage (power supply voltage Va) on the driving line 2, as shown in the portion (b) of FIG. 8. Thus, in this event, reactive power is reduced because of the elimination of the discharge associated with the resonance action as described above.

Further, when a bit sequence has pixel data bits DB at logical "0" in succession on one line, such as [0, 0, 0, 0, 0, 0, 0], for each display line, the switching element $SWZ_i$ remains off, as shown in the portion (c) of FIG. 8. Therefore, in this period, since no charges are recovered through the switching element $SWZ_{i0}$, charges which were not fully recovered by the capacitor CF gradually accumulate in the load capacitance Co. Consequently, the resonance pulse power supply voltage on the driving line 2 maintains the maximum voltage equal to the power supply voltage Va with the gradually falling resonance amplitude $V_1$, as shown in the portion (c) of FIG. 8.

Stated another way, when a bit sequence has pixel data bits DB at logical "0" in succession on one line, a voltage applied to the column electrode D need not either be reshaped into a pulse, so that the resonance power supply voltage applied to the driving line 2 is reduced in amplitude for transformation into a DC voltage, as shown in the portion (c) of FIG. 8. Thus, in this event, reactive power is reduced because of the elimination of the discharge associated with the resonance action as described above.

Here, according to the power supply circuit 210 shown in FIG. 6, the switching element S2 turns on and off at all times at a threshold based on the ground potential Vs, the switching element S2 correctly operates irrespective of fluctuations in the voltage across the capacitor CF. Thus, since the capacitor CF need not have a large capacitance in order to ensure a secure switching operation of the switching element S2, the driving apparatus can be reduced in size.

Alternatively, in FIG. 6, the capacitor CF and coil LF may be replaced in connection with each other. Specifically, one electrode of the coil LF is connected to one electrode of the capacitor CF, and the other electrode of the capacitor CF is connected to the driving line 2, while the other electrode of the coil LF is connected to the diode D1 (D2).

Further alternatively, in FIG. 6, the switching element S1 and diode D1 may be replaced in connection with each other.

Figure 9:
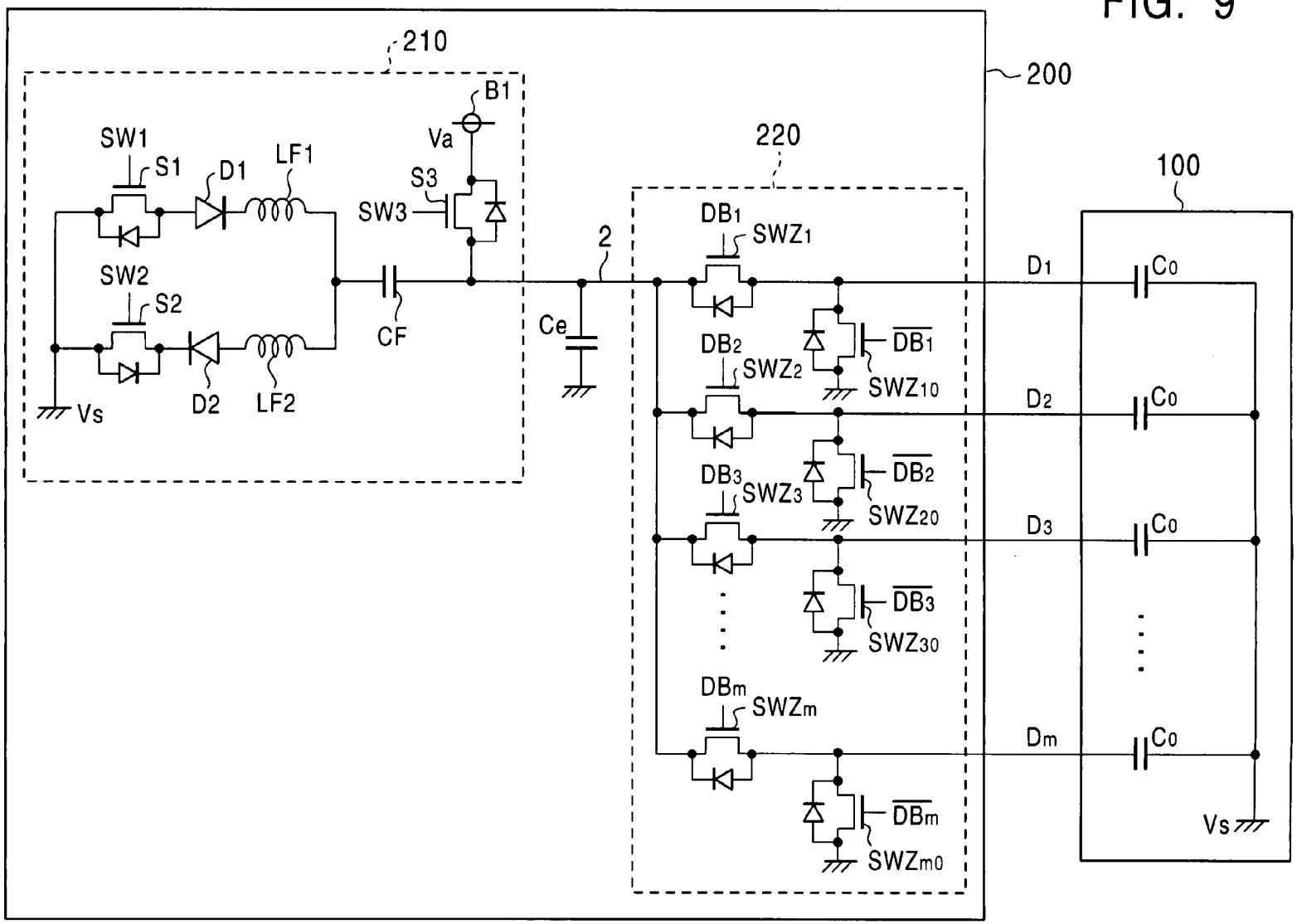
FIG. 9 is a diagram showing another configuration of the power supply circuit 210.

The coil LF shown in FIG. 6 may be divided into a coil LF1 on the discharging current path and a coil LF2 on the charging current path, as shown in FIG. 9. Also, in FIG. 9, the switching element S1, diode D1, and coil LF1 may be replaced in connection with one another, and similarly, the diode D2 and coil LF2 may also be replaced in connection with each other.

Figure 10:
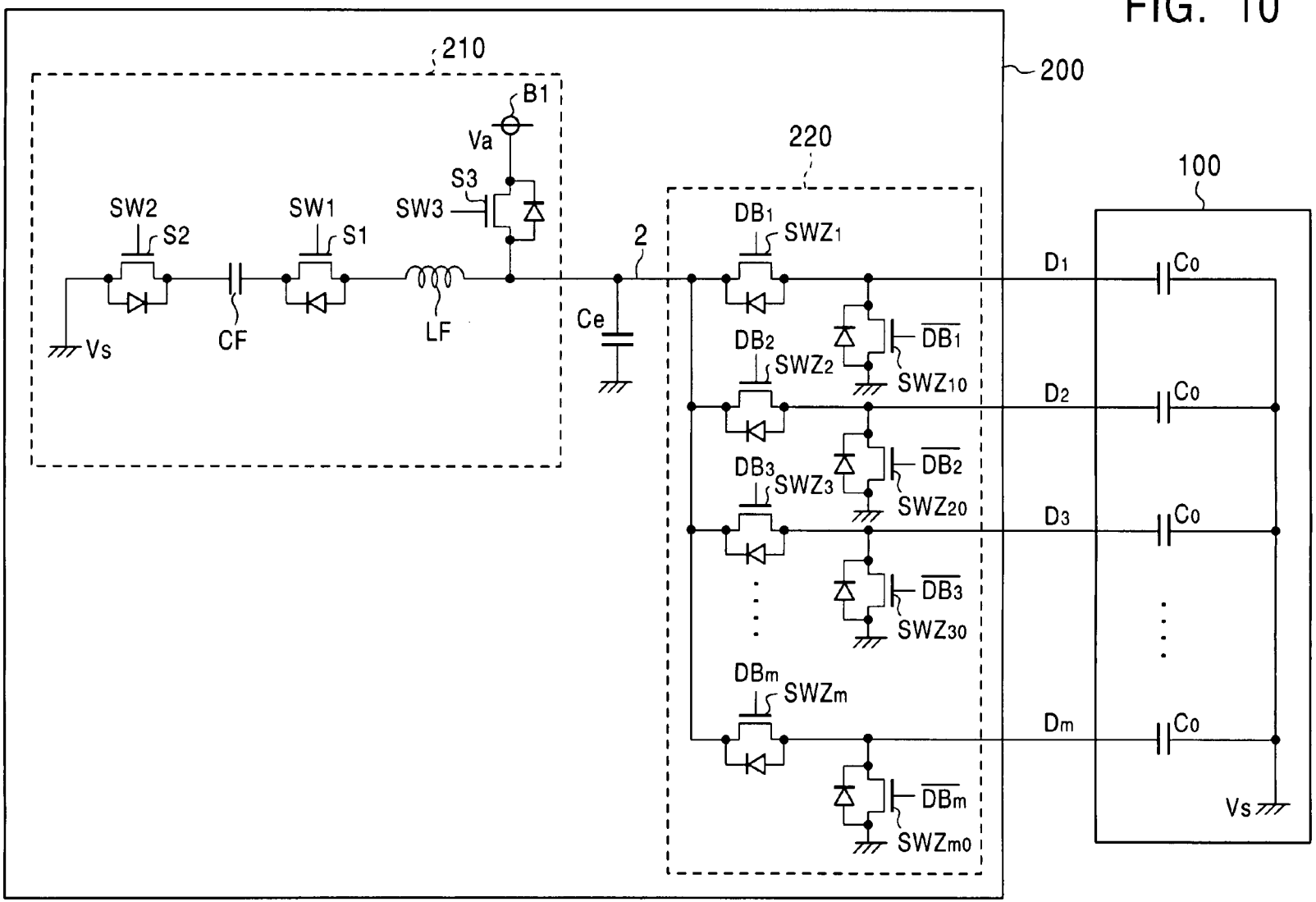
FIG. 10 is a diagram showing a further configuration of the power supply circuit 210.

The power supply circuit 210 may be configured as shown in FIG. 10 in place of the circuit configuration as shown in FIG. 6.

In the power supply circuit 210 shown in FIG. 10, the switching element S2 has the source electrode set at the ground potential Vs, and the drain electrode connected to one electrode of the capacitor CF. The other electrode of the capacitor CF is connected to the source electrode of the switching element S1. The switching element S1 has the drain electrode connected to one electrode of the coil LF. The other electrode of the coil LF is connected to the driving line 2. The switching element S3 has the source electrode connected to the positive electrode terminal of the DC power supply B1, and the drain electrode connected to the driving line 2. Alternatively, in FIG. 10, the coil LF, switching element S1, and capacitor CF may be replaced in connection with one another.

In addition, the power supply circuit 210 shown in FIG. 9 may contain a switching element for forcibly setting the driving line 2 to the ground potential.

Figure 11:
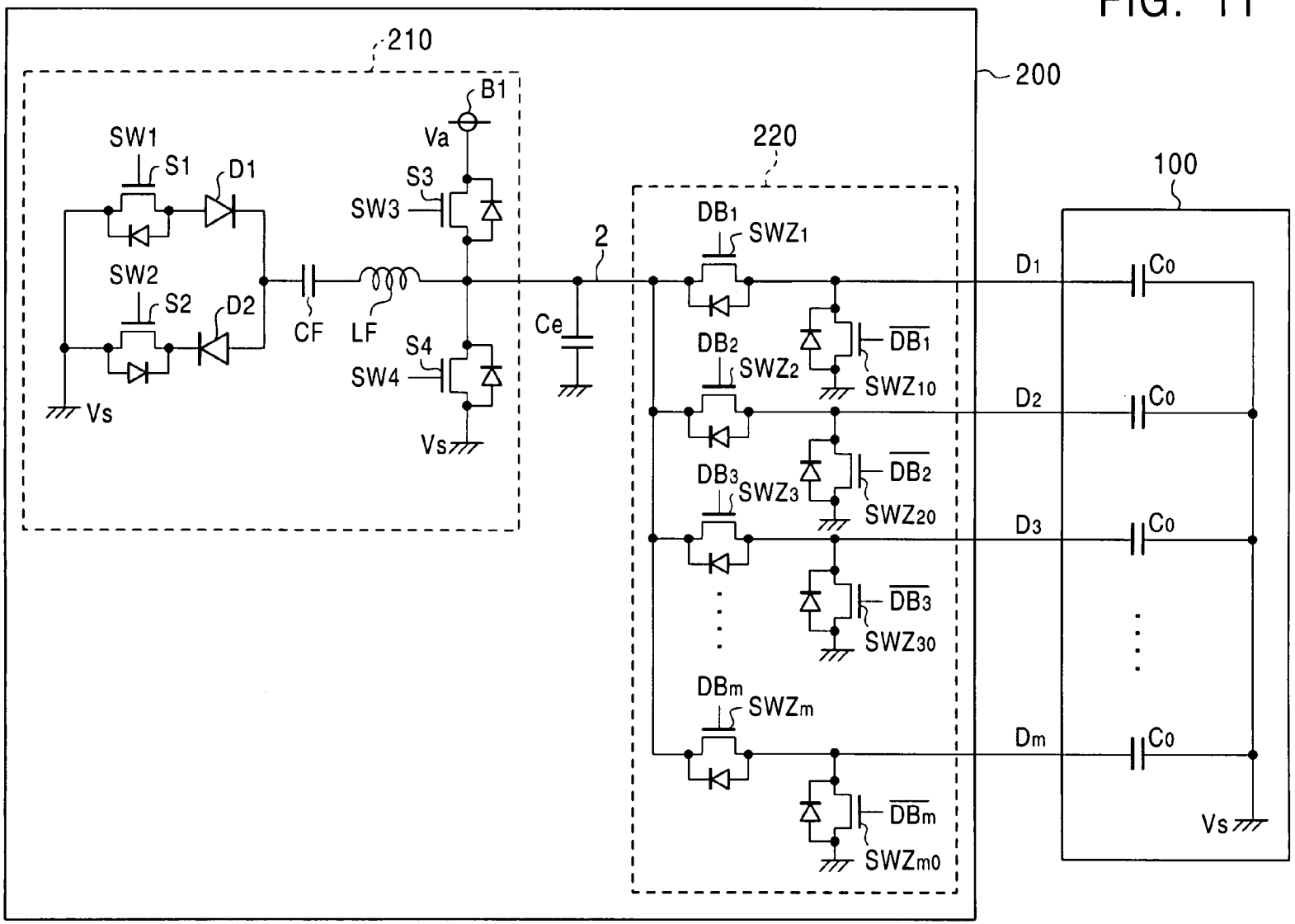
FIG. 11 is a diagram showing a further configuration of the power supply circuit 210.

FIG. 11 is a diagram showing another circuit configuration of the power supply circuit 210 in view of the foregoing modification.

In FIG. 11, the remaining configuration except for a switching element S4, i.e., the circuit configuration made up of the switching elements S1-S3, capacitor CF, coil LF, and diodes D1, D2 is the same as that shown in FIG. 9. The switching element S4 has a source electrode set at the ground potential Vs, and a drain electrode connected to the driving line 2. The driving control circuit 500 supplies a switching signal SW4 to a gate electrode of the switching element S4. The switching element S4 turns off when it is supplied with the switching signal SW4 at logical level "0." On the other hand, when supplied with the switching signal SW4 at logical level "1," the switching element S4 turns on to set the driving line 2 to the ground potential Vs.

Figure 12:
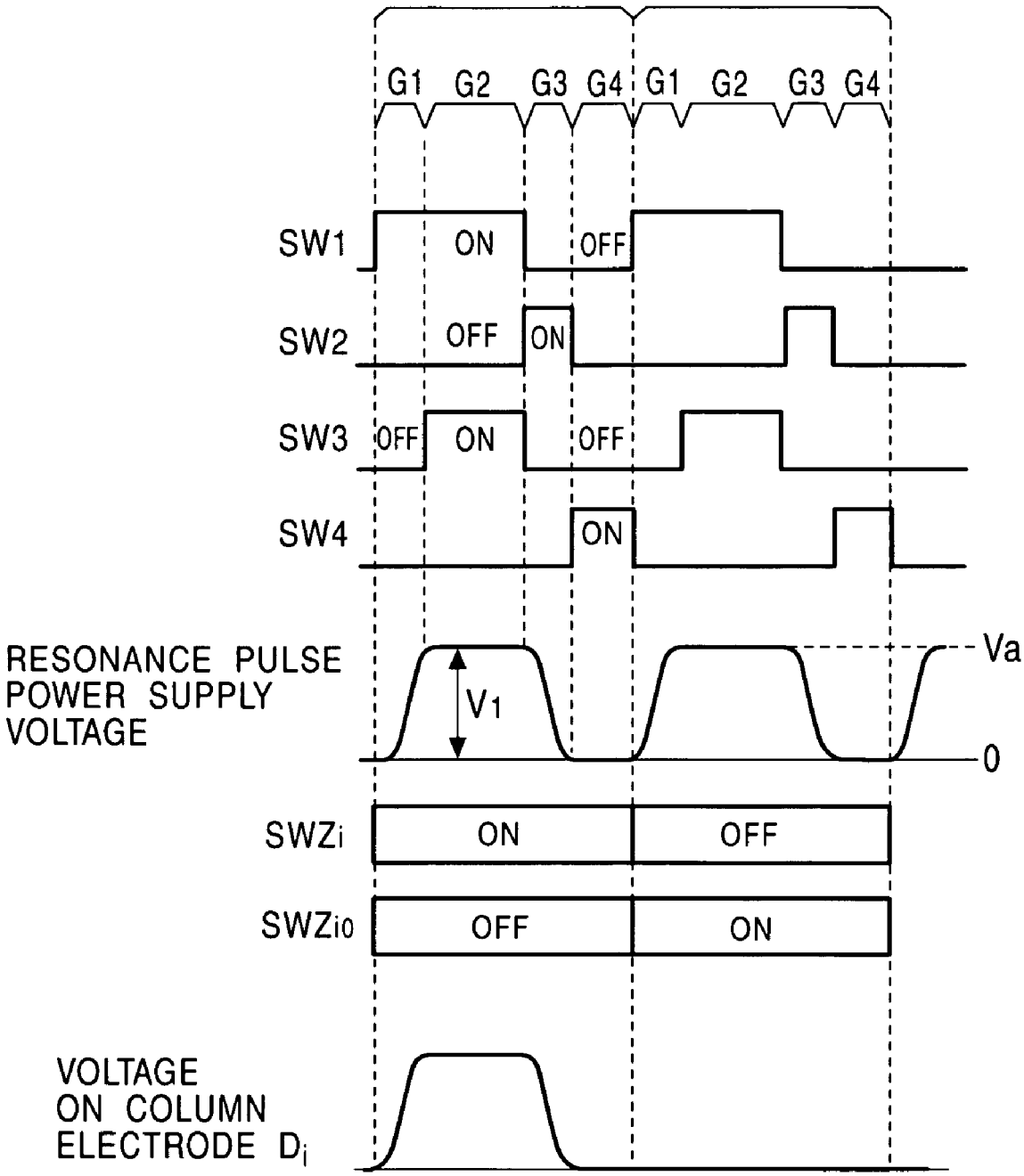
FIG. 12 is a diagram showing switching signals SW1-SW4 supplied by the driving control circuit 500 to switching elements S1-S4, respectively, of the power supply circuit 210 shown in FIG. 11.

FIG. 12 is a diagram showing the switching signals SW1-SW4 which are supplied to the switching elements S1-S4, respectively, of the power supply circuit 210 by the driving control circuit 500.

In FIG. 12, the driving control circuit 500 first supplies the switching element S1 with the switching signal SW1 at logical level "1," and supplies the switching elements S2-S4 with the switching signals SW2-SW4 at logical level "0" (driving stage G1). In response to the execution of the driving stage G1, only the switching element S1 of S1-S4 turns on to discharge charges charged on the capacitor CF. In this event, a current associated with the discharge flows into the driving line 2 through the coil LF, causing the voltage on the driving line 2 to gradually increase, as shown in FIG. 12. This voltage rising portion defines a front edge of the resonance pulse power supply voltage.

Next, the driving control circuit 500 switches the switching signal SW3 to logical level "1" (driving stage G2). In response to the execution of the driving stage G2, the switching element S3 turns on to apply the driving line 2 with the power supply voltage Va generated by the DC power supply B1. In other words, in this period the voltage on the driving line 2 is fixed to the power supply voltage Va which defines a maximum voltage for the resonance pulse power supply voltage having the resonance amplitude $V_1$.

Next, the driving control circuit 500 switches the switching signals SW1, SW3 to logical level "0," and switches the switching signal SW2 to logical level "1" (driving stage G3). In response to the execution of the driving stage G3, only the switching element S2 of S1-S4 turns on to set one electrode of the capacitor CF to the ground potential Vs. This causes a current to flow from the driving line 2 into the capacitor CF through the coil LF to charge the capacitor CF. The charging operation of the capacitor CF causes the voltage on the driving line 2 to gradually decrease as shown in FIG. 12. This voltage falling portion defines a rear edge of the resonance pulse power supply voltage.

Next, the driving control circuit 500 switches the switching signal SW2 to logical level "0," and switches the switching signal SW4 to logical level 1 (driving stage G4). In response to the execution of the driving stage G4, only the switching element S4 of S1-S4 turns on to set the driving line 2 to the ground potential Vs (zero volt).

The driving control circuit 500 repeatedly executes the driving sequence shown in the foregoing driving stages G1-G4. In this period, as a pixel data bit $DB_i$ at logical level "1" is supplied, the resonance pulse power supply voltage on the driving line 2 is applied as it is to the column electrode $D_i$ as a high-voltage data pulse DP. On the other hand, as a pixel data bit $DB_i$ at logical level "0" is supplied, the ground potential Vs (zero volt) is applied to the column electrode $D_i$ as a low-voltage data pulse DP.

The switching element S4 shown in FIG. 11 may be employed in the power supply circuit 210 shown in FIG. 10.

Also, in FIG. 12, the switching element S1 may be on in the driving stage G2, and the switching element S2 may be on in the driving stage G4.

In the foregoing embodiment, a power supply circuit for generating a resonance pulse power supply voltage such as the power supply circuit 210 is employed in the column electrode driving circuit 200, however, a power supply circuit for generating such a resonance pulse power supply voltage may be employed in the row electrode driving circuit 300 or 400.

Figure 13:
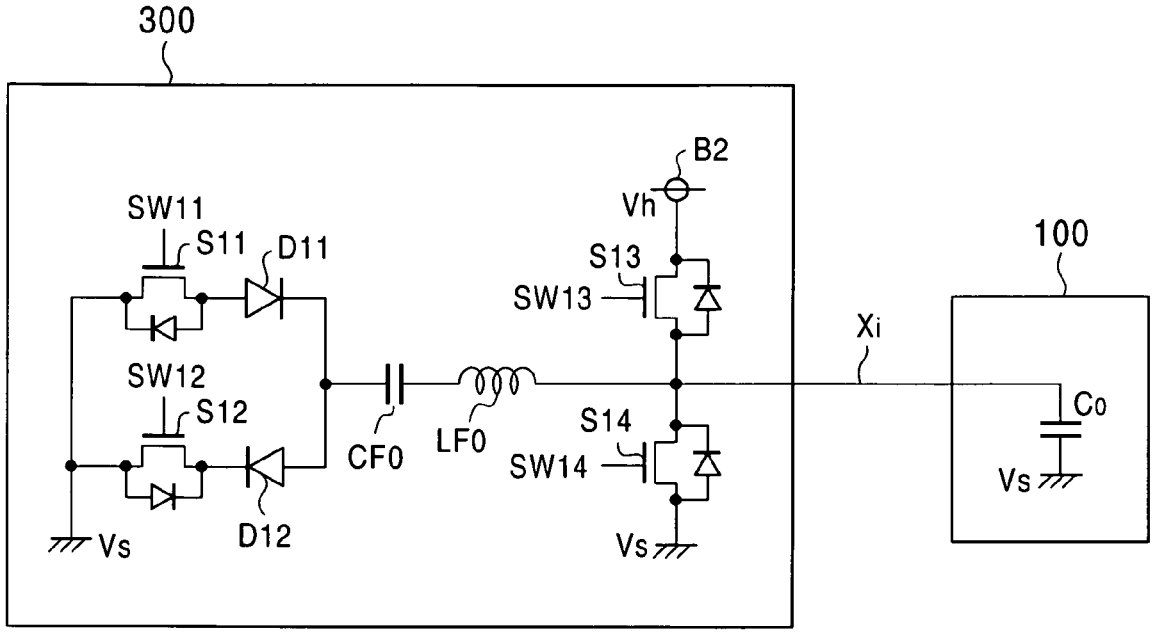
FIG. 13 is a diagram showing the internal configuration of a row electrode driving circuit 300.

FIG. 13 is a diagram showing an exemplary internal configuration of the row electrode driving circuit 300 which is designed in view of the foregoing modification.

In FIG. 13, switching elements S11-S14 are FETs (Field Effect Transistor). The switching element S11 has a source electrode set at the ground potential Vs, and a drain electrode connected to an anode electrode of a diode D11. The switching element S11 is supplied at its gate electrode with a switching signal SW11 sent from the driving control circuit 500. The switching element S12 has a source electrode set at the ground potential Vs, and a drain electrode connected to a cathode electrode of a diode D12. The switching element S12 is supplied at its gate electrode with a switching signal SW12 sent from the driving control circuit 500. A cathode electrode of the diode D11 and an anode electrode of the diode D12 are commonly connected to one electrode of a capacitor CF0. The other electrode of the capacitor CF0 is connected to one electrode of a coil LF0. The other electrode of the coil LF0 is connected to the row electrode $X_i$ of the PDP 100. The switching element S13 has a source electrode connected to a positive electrode terminal of a DC power supply B2, and a drain electrode connected to the row electrode $X_i$. The switching element S13 is supplied at its gate electrode with a switching signal SW13 sent from the driving control circuit 500. The switching element S13 turns off when the switching signal S13 is at logical level "0," while the switching element S13 turns on when the switching signal SW13 is at logical level "1" to apply the row electrode $X_i$ with a power supply voltage $V_h$ generated in the DC power supply B2. The switching element S14 has a source electrode set at the ground potential Vs, and a drain electrode connected to the row electrode $X_i$. The driving control circuit 500 supplies a switching signal SW14 to a gate electrode of the switching element S14. The switching element S14 turns off when it is supplied with the switching signal SW14 at logical level "0," and turns on when it is supplied with the switching signal SW14 at logical level "1" to set the row electrode $X_i$ to the ground potential Vs.

Figure 14:
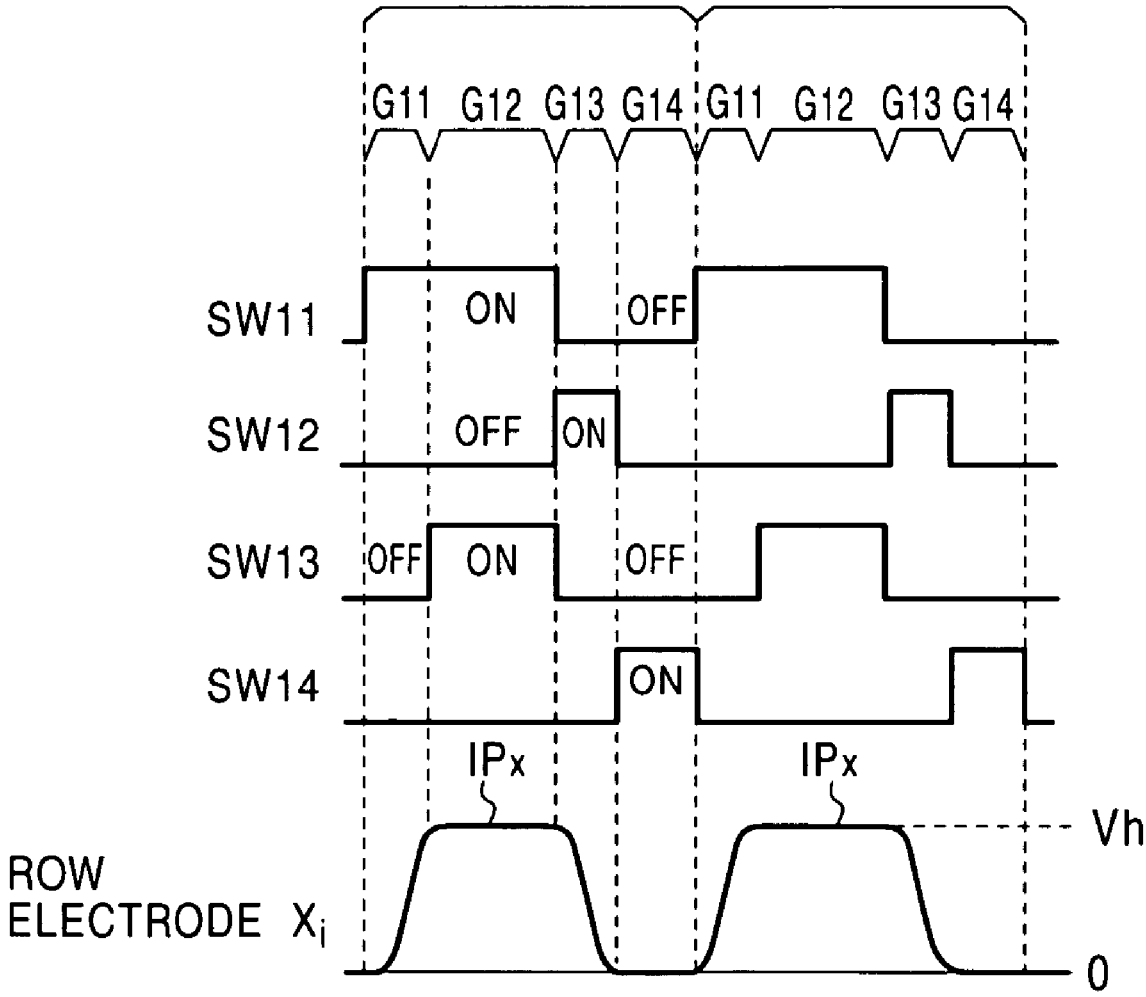
FIG. 14 is a diagram showing switching signals SW11-SW14 supplied by the driving control circuit 500 to switching elements S11-S14 of the row electrode driving circuit 300 shown in FIG. 13, and a sustain pulse generated in the row electrode driving circuit 300.

FIG. 14 is a diagram showing a sequence of the switching signals SW11-SW14 supplied from the driving control circuit 500 for driving the row electrode driving circuit 300 shown in FIG. 13.

First, the driving control circuit 500 supplies the switching element S11 with the switching signal SW11 at logical level "1," and supplies the switching elements S12-S14 with the switching signals SW12-SW14 at logical level "0," respectively (driving stage G11). In response to the execution of the driving stage G11, only the switching element S11 of S11-S14 turns on to discharge charges charged on the capacitor CF0. In this event, a current associated with the discharge flows into the row electrode $X_i$ through the capacitor CF0, causing the voltage on the row electrode $X_i$ to gradually increase, as shown in FIG. 14. Such a voltage rising portion defines a front edge of the sustain pulse $IP_X$ as shown in FIG. 5.

Next, the driving control circuit 500 switches the switching signal SW13 to logical level "1" (driving stage G12). In response to the execution of the driving stage G12, the switching element S13 turns on to apply the row electrode $X_i$ with the power supply voltage $V_h$ generated by the DC power supply B2 to charge a load capacitance Co of the PDP 100. In this period, the voltage on the row electrode $X_i$ is fixed to the power supply voltage $V_h$ which defines a pulse voltage of the sustain pulse $IP_X$.

Next, the driving control circuit 500 switches the switching signals SW11, SW13 to logical level "0," and switches the switching signal SW12 to logical level "1" (driving stage G13). In response to the execution of the driving stage G13, only the switching element S12 of S11-S14 turns on, causing the load capacitance Co of the PDP 100 to start charging. In this event, a discharge current flows into a current path including the row electrode $X_i$, coil LF0, capacitor CF0, diode D12, and switching element S12, causing the capacitor CF0 to start charging. In other words, charges accumulated in the load capacitance Co of the PDP 100 is recovered by the capacitor CF0. In this event, the voltage on the row electrode $X_i$ gradually decreases in accordance with the time constant determined by the coil LF0 and load capacitance Co. This slowly falling voltage portion defines a rear edge of the sustain pulse $IP_x$.

Next, the driving control circuit 500 switches the switching signal SW12 to logical level "0," and switches the switching signal SW14 to logical level "1" (driving stage G14). In response to the execution of the driving stage G14, only the switching element S14 of S11-S14 turns on to set the row electrode $X_i$ to the ground potential Vs (zero volt).

The driving control circuit 500 repeatedly executes the driving sequence shown in the driving stages G11-G14 to repeatedly generate the sustain pulse $IP_X$ on the row electrode X.

Figure 15:
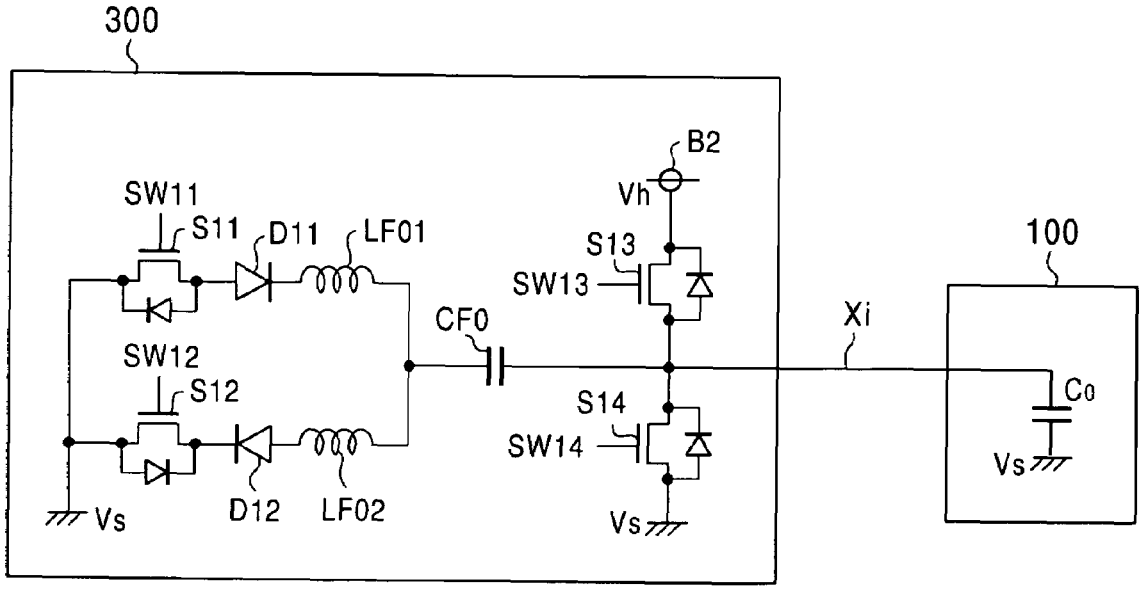
FIG. 15 is a diagram showing another configuration of the row electrode driving circuit 300.

Alternatively, the coil LF0 shown in FIG. 13 may be divided into a coil LF01 on the discharging current path and a coil LF02 on the charging current path, as shown in FIG. 15.

Figure 16:
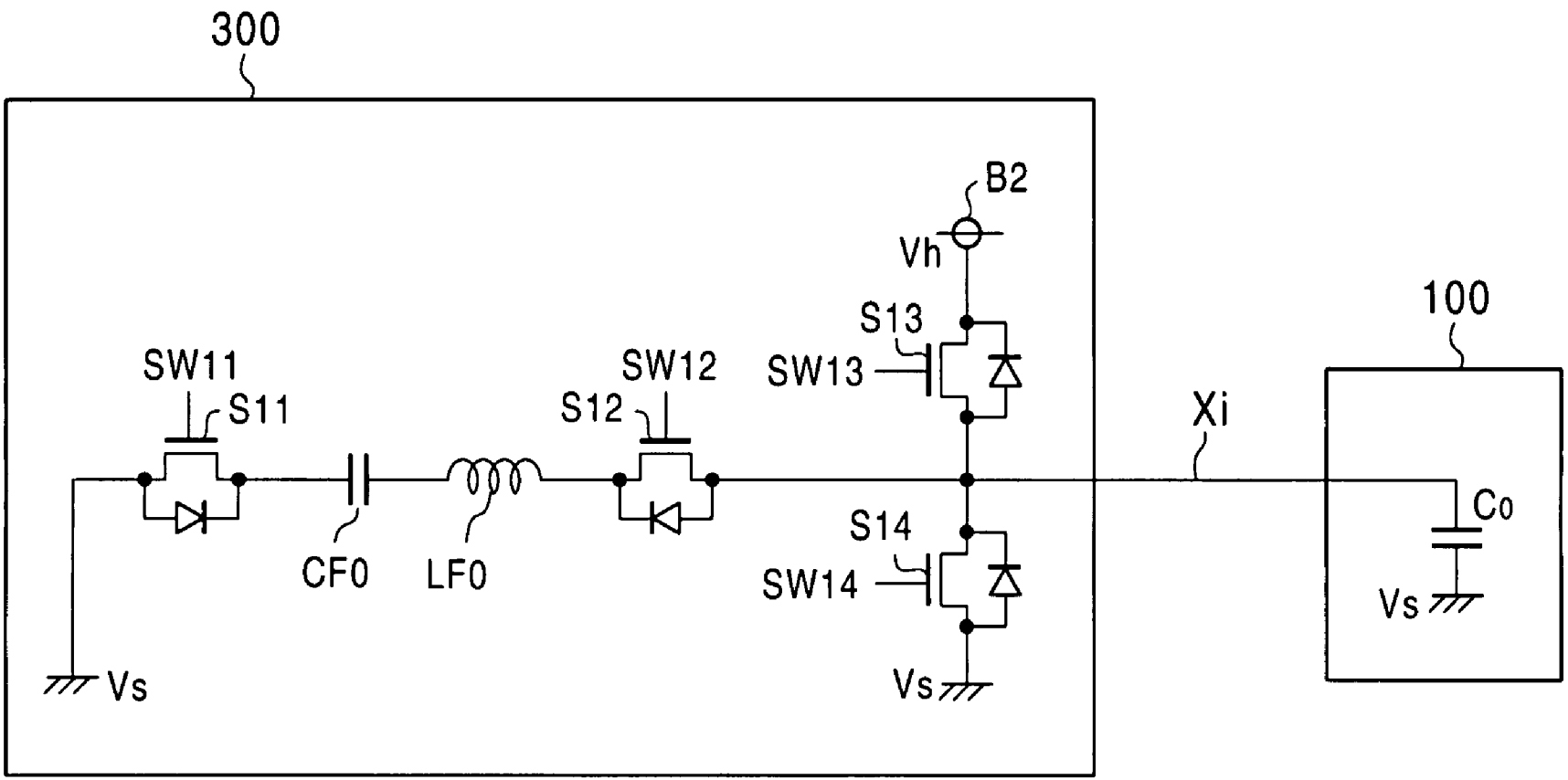
FIG. 16 is a diagram showing a further configuration of the row electrode driving circuit 300.

Also, the row electrode driving circuit 300 may employ a circuit configuration as shown in FIG. 16 instead of the circuit configuration shown in FIG. 13.

In the row electrode driving circuit 300 shown in FIG. 16, the switching element S11 has the source electrode set at the ground potential Vs, and the drain electrode connected to one electrode of the capacitor CF0. The other electrode of the capacitor CF0 is connected to one electrode of the coil LF0. The switching element S12 has the source electrode connected to the other electrode of the coil LF0, and the drain electrode connected to the row electrode $X_i$ of the PDP 100. The configuration of the switching elements S3, S4 is the same as that shown in FIG. 13.

Figure 17:
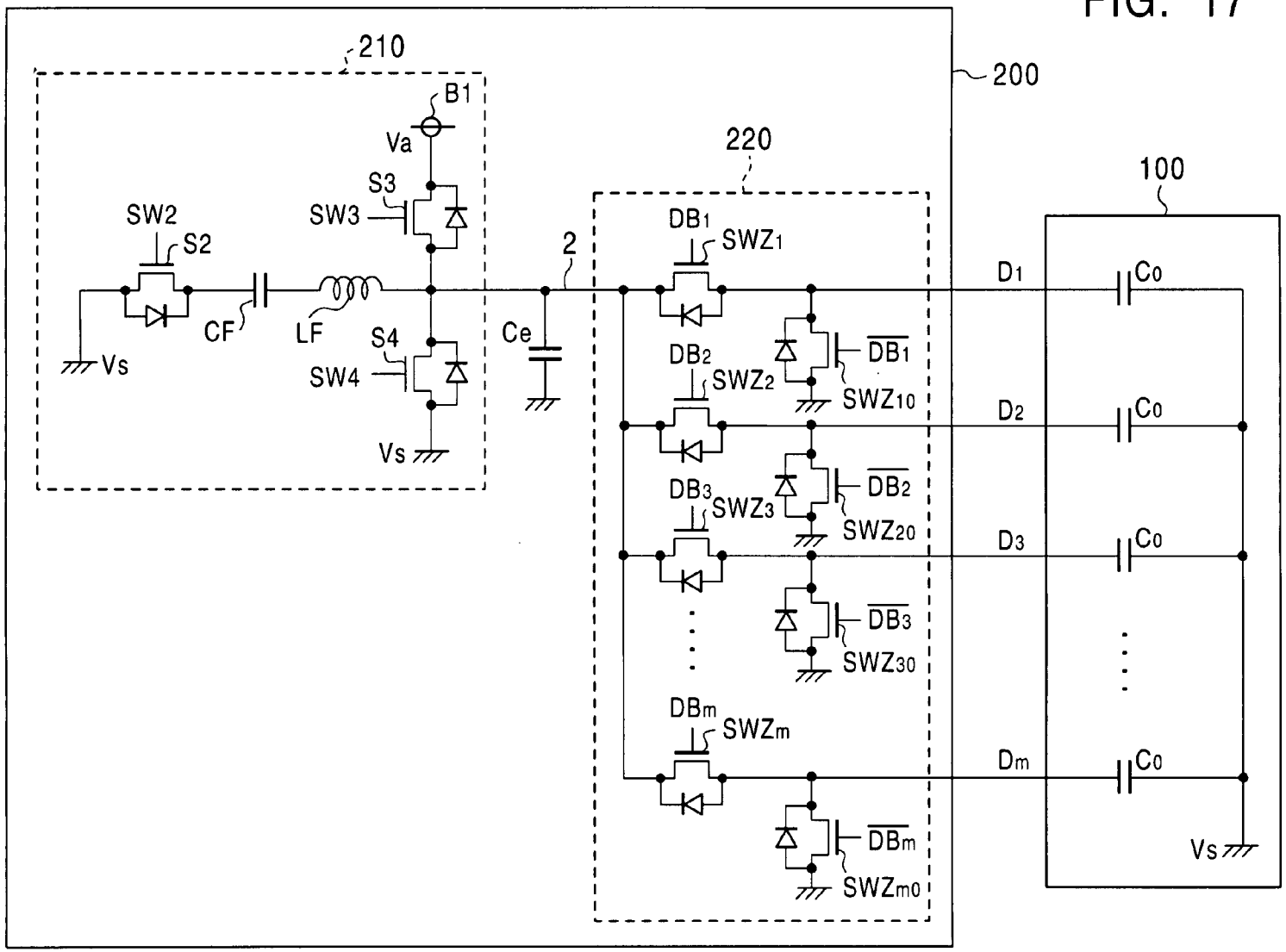
FIG. 17 is a diagram showing another configuration of the power supply circuit 210 shown in FIG. 11.

Alternatively, the switching element S1 and diodes D1, D2 disposed in the power supply circuit 210 shown in FIG. 11 may be removed to modify the power supply circuit 210 into a circuit configuration as shown in FIG. 17.

Figure 18:
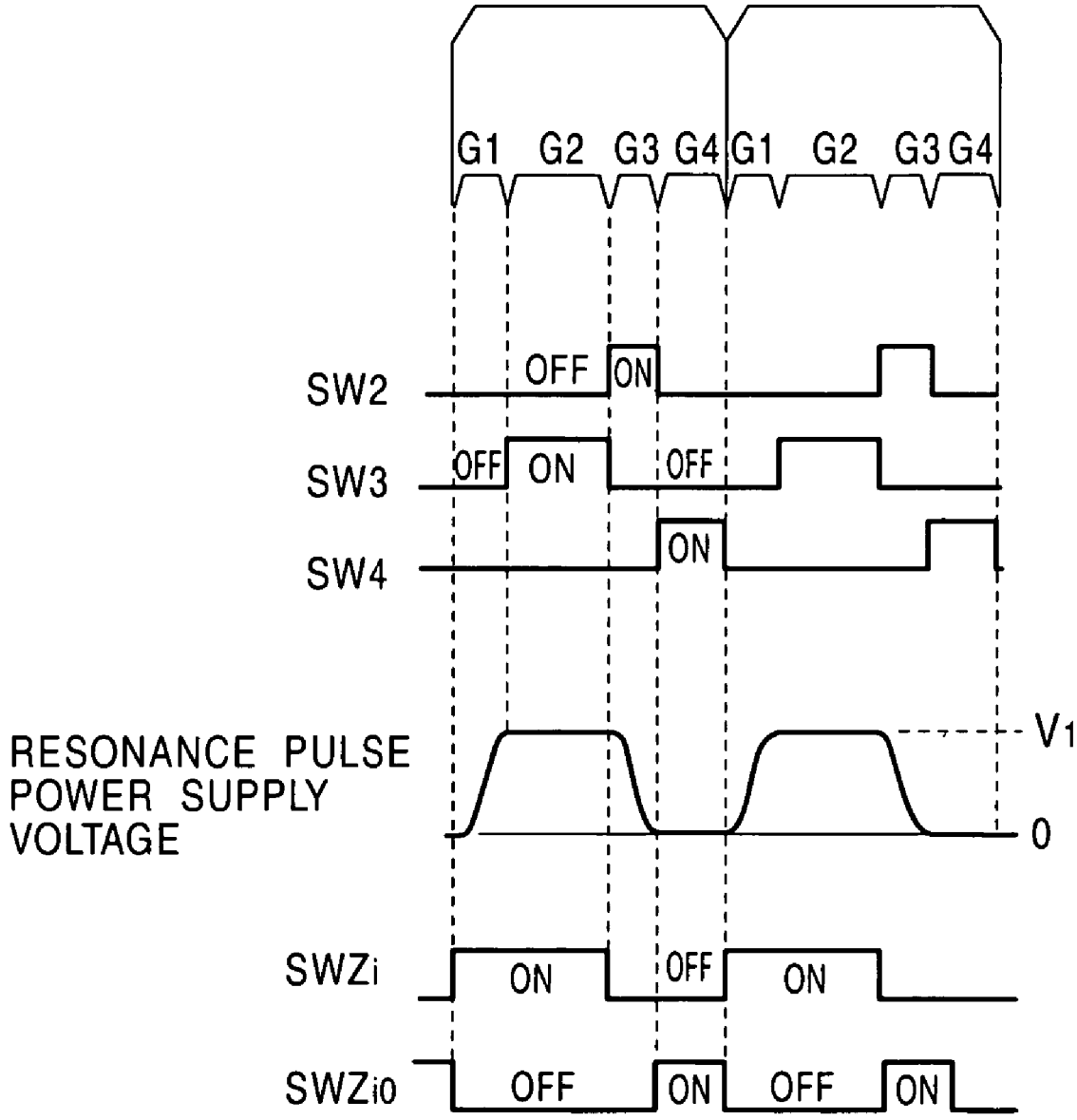
FIG. 18 is a diagram showing driving timings within the power supply circuit 210 shown in FIG. 17.

FIG. 18 is a diagram showing on/off control timings for each of the switching signals SW2-SW4 supplied to the switching elements S2-S4, respectively, by the driving control circuit 500 for driving the power supply circuit 210 shown in FIG. 17, and the switching elements $SWZ_i$, $SWZ_{i0}$ which are turned on/off in response to the pixel data bit DB at logical level "1."

In FIG. 18, the driving control circuit 500 first supplies the switching signals SW2-SW4 at logical level "0" to turn off all of the switching elements S2-S4 (driving stage G1). In this period, the switching element $SWZ_i$ is turned on, while $SWZ_{i0}$ is turned off, so that charges charged on the capacitor CF are discharged, causing a current associated with the discharge to flow into the driving line 2 to gradually increase the voltage on the driving line 2 as shown in FIG. 18. Such a voltage rising portion defines a front edge off the resonance pulse power power supply voltage.

Next, the driving control circuit 500 switches the switching signal SW3 to logical level "1" to turn on the switching element S3 (driving stage G2). In response to the execution of the driving stage G2, the driving line 2 is applied with the power supply voltage Va generated by the DC power supply B1. In other words, the voltage on the driving line 2 is fixed in this period to the power supply voltage Va which defines a maximum voltage for the resonance pulse power supply voltage having the resonance amplitude $V_1$.

Next, the driving control circuit 500 switches the switching signal SW3 to logical level "0," and switches the switching signal SW2 to logical level "1." Further, the driving control circuit 500 switches the switching element $SWZ_i$ from the on-state to the off-state (driving stage G3). In response to a transition to the driving stage G3, only the switching element S2 turns on to set one electrode of the capacitor CF to the ground potential Vs. This causes a current to flow from the driving line 2 to the capacitor CF through the coil LF to charge the capacitor CF. The charging operation of the capacitor CF causes the voltage on the driving line 2 to gradually decrease as shown in FIG. 18. This voltage falling portion defines a rear edge of the resonance pulse power supply voltage.

Next, the driving control circuit 500 switches the switching signal SW2 to logical level "0," and switches the switching signal SW4 to logical level "1." Further, the driving control circuit 500 switches the switching element $SWZ_{i0}$ to the on-state (driving stage G4). In response to the execution of the driving stage G4, the switching elements S4 and $SWZ_{i0}$ turn on to set the driving line 2 to the ground potential Vs (zero volt).

Figure 19:
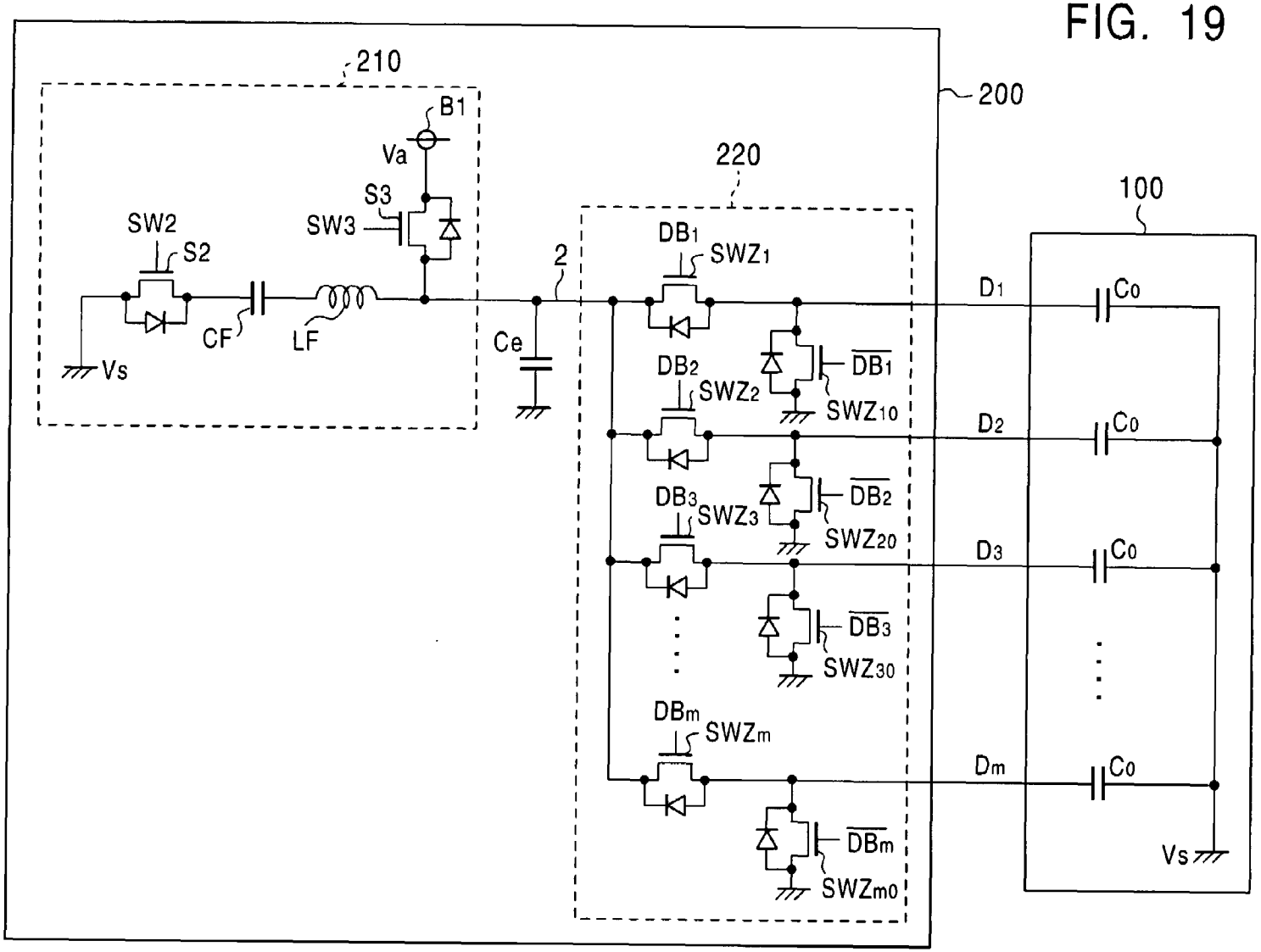
FIG. 19 is a diagram showing a further configuration of the power supply circuit 210 shown in FIG. 17.

Alternatively, the power supply circuit 210 may employ the circuit configuration as shown in FIG. 19 which removes the switching element S4 shown in FIG. 17.

Figure 20:
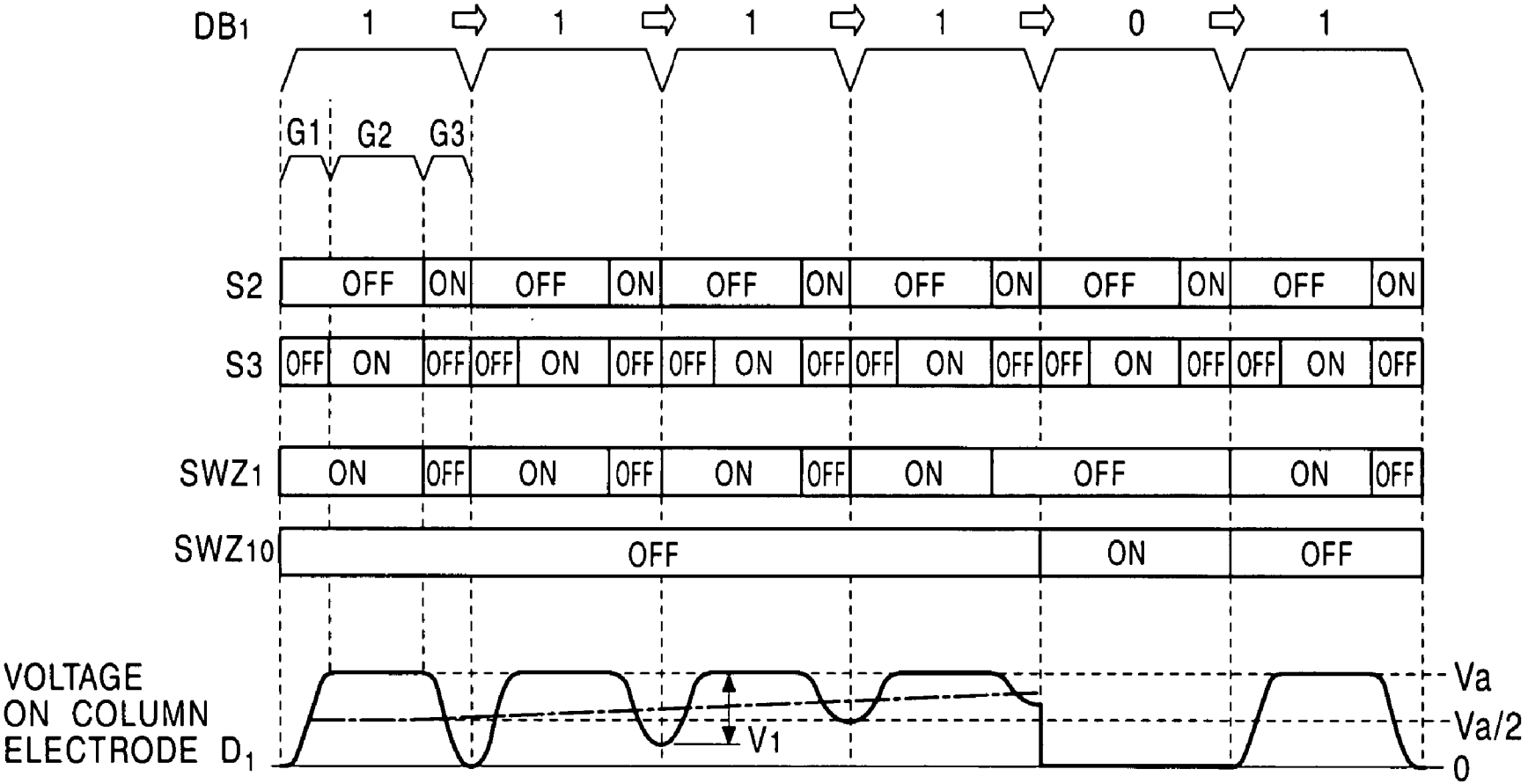
FIG. 20 is a diagram representing the internal operation of the column electrode driving circuit 200 shown in FIG. 19.

FIG. 20 is a diagram showing an exemplary internal operation in the power supply circuit 210 and image data pulse generator circuit 220 shown in FIG. 19.

The example shown in FIG. 20 shows extracted operations performed by the switching elements $SWZ_1$, $SWZ_{10}$ in the pixel data pulse generator circuit 220 in response to an image data bit $DB_1$ of a bit sequence such as [1, 1, 1, 1, 0, 1].

As shown in FIG. 20, the driving control circuit 500 first turns off the switching elements S2, S3 in the power supply circuit 210 for a predetermined first duration (driving stage G1). Next, the driving control circuit 500 turns on only the switching element S3 of S2, S3 for a predetermined second duration (driving stage G2). Then, the driving control circuit 500 turns on only the switching element S2 of S2, S3 for the predetermined first duration (driving stage G3). The driving control circuit 500 repeatedly executes the switching sequence comprised of the driving stages G1-G3 corresponding to each bit in the bit sequence comprised of the pixel data bits DB.

The switching element $SWZ_{10}$ is set to turn off when the pixel data bit $DB_1$ is at logical level "1" during the period in which the driving stages G1-G3 are executed, and is set to turn on when the pixel data bit $DB_1$ is at logical level "0." The switching element $SWZ_1$ is set to turn off during the period in which the driving stages G1-G3 are executed when the pixel data bit DB1 is at logical level "0." On the other hand, when the pixel data bit $DB_1$ is at logical level "1," the switching element $SWZ_1$ is set to turn on during the period in which the driving stages G1, G2 are executed, and set to turn off during the period in which the driving stage G3 is executed.

In this event, when the data bit $DB_1$ is at logical level "1," only the switching element $SWZ_1$ of the switching elements S2, S3, $SWZ_1$, $SWZ_{10}$ turns on in the driving stage G1. This causes the charges accumulated on the capacitor CF to be discharged, and a discharge current associated with the discharge flows into the column electrode $D_1$ of the PDP 100 through the driving line 2 and switching element $SWZ_1$. Consequently, the load capacitance Co parasitic on the column electrode $D_1$ is charged to accumulate charges in the load capacitance Co. In this event, the resonance action of the coil LF and load capacitance Co causes the voltage on the column electrode $D_1$ to gradually increase, as shown in FIG. 20. Here, immediately before the lapse of a period corresponding to one-half period of the resonance, the driving control circuit 500 transitions to the execution of the driving stage G2. In the driving stage G2, only the switching elements S3, $SWZ_1$ of the switching elements S2, S3, $SWZ_1$, $SWZ_{10}$ turn on. In this period, the power supply voltage Va generated by the DC power supply B1 is directly applied to the column electrode $D_1$ through the switching elements S3, $SWZ_1$. With the voltage thus applied, the load capacitance Co parasitic on the column electrode $D_1$ of the PDP 100 is continuously charged. Then, as the driving stage G3 is executed, only the switching element S2 of the switching elements S2, S3, $SWZ_1$, $SWZ_{10}$ turns on to set one electrode of the capacitor to the ground potential Vs. This causes the load capacitance Co of the PDP 100 to start discharging, and the resulting discharge current flows through a current path including the column electrode $D_1$, switching element $SWZ_1$, driving line 2, coil LF, capacitor CF, and switching element S2, causing the capacitor CF to start charging. In other words, the charges accumulated in the load capacitance Co of the PDP 100 is recovered by the capacitor CF. In this event, the voltage on the column electrode $D_1$ gradually decreases in accordance with a time constant determined by the coil LF and load capacitance Co, a shown in FIG. 20.

On the other hand, when the pixel data bit $DB_1$ is at logical level "0," the switching element $SWZ_{10}$ turns on to ground the column electrode $D_1$, so that the voltage on the column electrode D1 is fixed at zero volt, as shown in FIG. 20, in this period.

Here, the power supply circuit 210 shown in FIG. 19 is not provided with the switching element S4 for forcibly grounding the driving line 2. Therefore, when a bit sequence has pixel data bits DB at logical "1" in succession on one line, no charges are consumed, for example, by a current path including the column electrode $D_1$ and switching element $SWZ_{10}$. Thus, charges which were not fully recovered into the capacitor CF in the driving stage G3 are gradually accumulated in the load capacitance Co of the PDP 100. As a result, the high-voltage pixel data pulse applied to the column electrode D maintains the maximum voltage at the power supply voltage Va with its resonance amplitude $V_1$ gradually decreasing.

The invention claimed is:

1. An apparatus for driving capacitive light emitting elements by supplying the capacitive light emitting elements with a driving pulse having a varying voltage with a predetermined amplitude through a driving line, said apparatus comprising:

a resonance current path including:

a capacitor interposed in said resonance circuit path, said capacitor having a couple of terminals separated from the ground;

a first switching element for supplying said driving line with a current in accordance with charges accumulated on said capacitor when said first switching element is on; and a second switching element for grounding one electrode of said capacitor when said second switching element is on to supply the other electrode of said capacitor with a current in accordance with the charges accumulated on said capacitive light emitting element through said driving line, and a third switching element for applying a predetermined voltage to said driving line when said third switching element is on.

2. An apparatus for driving capacitive light emitting elements according to claim 1, wherein said resonance current path comprises a first resonance current path including said capacitor and said first switching element, and a second resonance current path including said capacitor and said second switching element.

3. An apparatus for driving capacitive light emitting elements according to claim 2, wherein:

said first resonance current path includes a series circuit comprised of said first switching element, a first diode, said capacitor, and a coil, and said second resonance current path includes a series circuit comprised of said second switching element, a second diode, said capacitor, and said coil.

4. An apparatus for driving capacitive light emitting elements according to claim 2, wherein:

said first resonance current path includes a series circuit comprised of said first switching element, a first diode, a first coil, and said capacitor, and said second resonance current path includes a series circuit comprised of said second switching element, a second diode, a second coil, and said capacitor.

5. An apparatus for driving capacitive light emitting elements according to claim 1, further comprising a fourth switching element for grounding said driving line when said fourth switching element is on.

6. An apparatus for driving capacitive light emitting elements according to claim 1, wherein said first switching element grounds the one electrode of said capacitor when said first switching element is on to supply said driving line with a current in accordance with the charges accumulated on said capacitor through the other electrode of said capacitor.

7. An apparatus for driving capacitive light emitting elements according to claim 1, wherein:

said resonance current path comprises: a coil having one electrode connected to said driving line; said capacitor; a first switching element for connecting the one electrode of said capacitor with the other electrode of said coil when said first switching element is on; and a second switching element for grounding the other electrode of said capacitor when said second switching element is on.

* * * * *

UNITED STATES PATENT AND TRADEMARK OFFICE

CERTIFICATE OF CORRECTION

PATENT NO. : 7,345,662 B2
APPLICATION NO. : 10/862882
DATED : March 18, 2008
INVENTOR(S) : Takashi Iwami It is certified that error appears in the above-identified patent and that said Letters Patent is hereby corrected as shown below:

Column 14, line 5 (claim 1), delete “circuit” and insert --current--

Signed and Sealed this

Sixteenth Day of September, 2008

JON W. DUDAS
*Director of the United States Patent and Trademark Office*